US007980080B2

(12) United States Patent
Pickette et al.

(10) Patent No.: US 7,980,080 B2
(45) Date of Patent: Jul. 19, 2011

(54) FLUID COUPLED HEAT TO MOTION CONVERTER (A FORM OF HEAT ENGINE) FCHTMC

(76) Inventors: Wayne Douglas Pickette, Champaign, IL (US); James Robert Fisher, Iron Mountain, MI (US); Gregory James Danner, Urbana, IL (US)

( * ) Notice: Subject to any disclaimer, the term of this patent is extended or adjusted under 35 U.S.C. 154(b) by 612 days.

(21) Appl. No.: 11/561,393

(22) Filed: Dec. 10, 2006

(65) Prior Publication Data

US 2008/0134662 A1 Jun. 12, 2008

(51) Int. Cl.
*F01K 25/00* (2006.01)
*F01K 25/08* (2006.01)

(52) U.S. Cl. ..... 60/671; 60/651

(58) Field of Classification Search ..... 60/516–526, 60/645, 651, 670, 671
See application file for complete search history.

(56) References Cited

U.S. PATENT DOCUMENTS

| | | | | |
|---|---|---|---|---|
| 4,186,559 | A * | 2/1980 | Decker et al. | 60/531 |
| 4,597,321 | A * | 7/1986 | Gabelish et al. | 91/470 |
| 6,595,006 | B2 * | 7/2003 | Thiesen et al. | 62/6 |
| 6,701,708 | B2 * | 3/2004 | Gross et al. | 60/517 |
| 6,808,162 | B2 * | 10/2004 | Tranovich et al. | 251/209 |

* cited by examiner

*Primary Examiner* — Thomas E Denion
*Assistant Examiner* — Christopher Jetton

(57) ABSTRACT

FCHTMC engine defines a new device, not any makeover. Some instances of conflict, which may arise in general claims for the Stirling or all other engines, are, therefore, of no consequences. This engine improves over the power, efficiency, size, weight, complicity, and versatility of the Stirling and other engines—all known to this date. This application makes the use of the specific refrigerant, Duracool™, for propulsion, not cooling, and the use of the specific ceramic Z500. Multiple horizontal layers describe the engine inner configuration within these layers, defining the space for internal components, providing a simplicity of assembly/dis-assembly and the pipes' usage in structure. The meaning—pipes are incorporated inside of the device, excluding external piping. This style of construction defines the unimpeded access to improve manufacturing costs. This device is a single-hot cycle, multi-cylinder, and none-rotary engine without any vibratory or gyroscopic reactions.

2 Claims, 29 Drawing Sheets

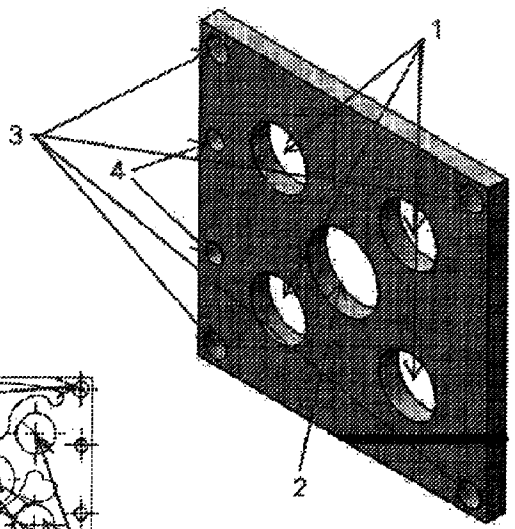
Fig. 5b
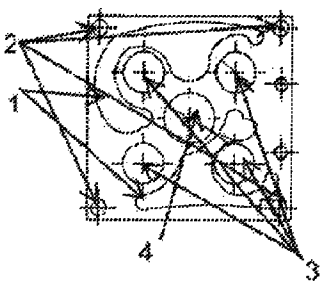
Fig. 5a
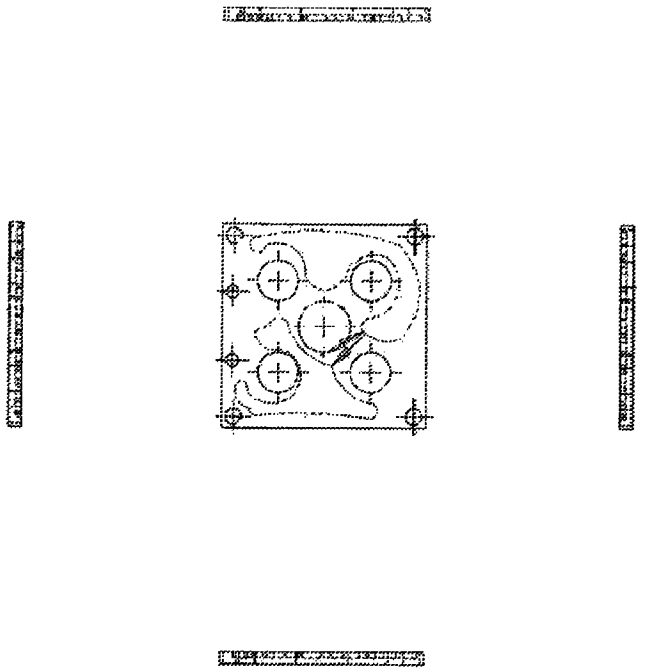

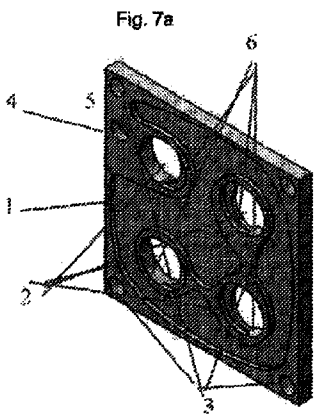
Fig. 7a
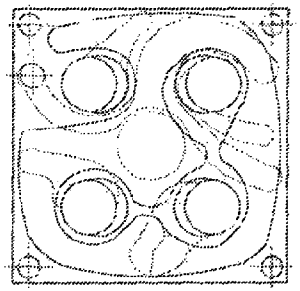
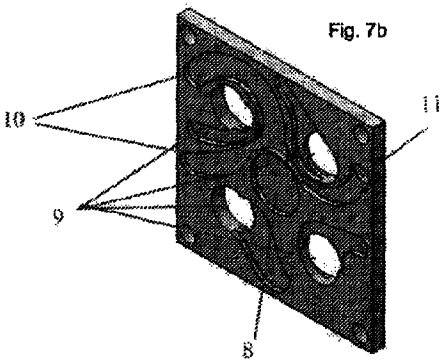
Fig. 7b
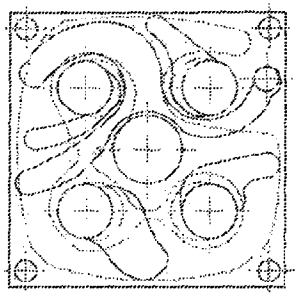
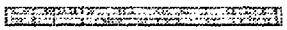

1
2
3
4
5
6
7
8
9

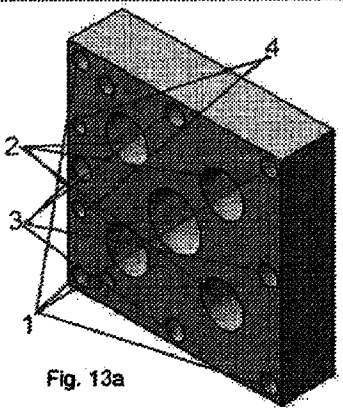
Fig. 13a
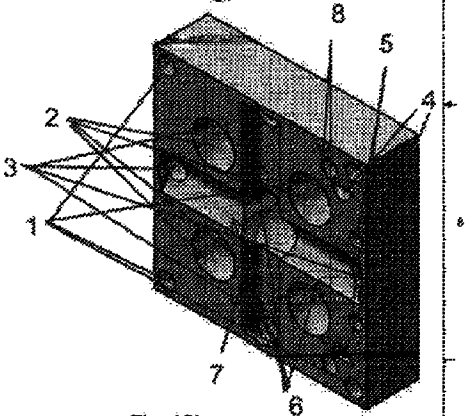
Fig. 13b
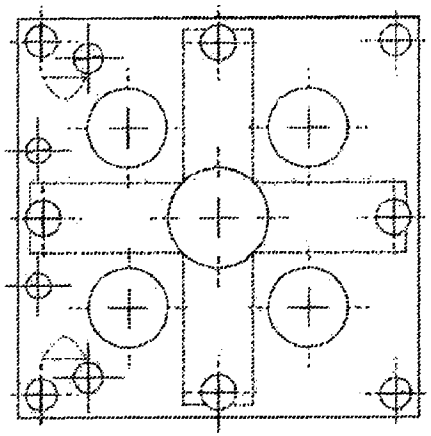
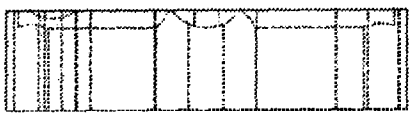
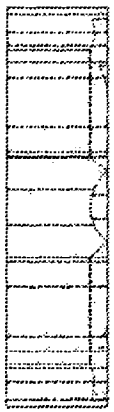

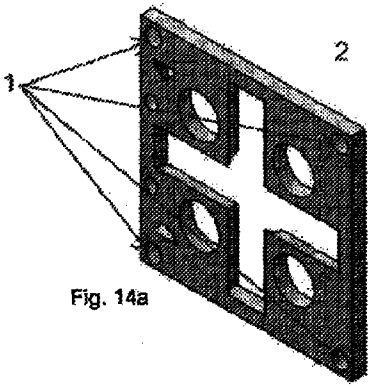
Fig. 14a
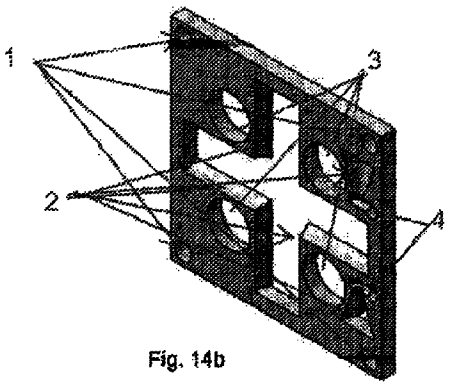
Fig. 14b
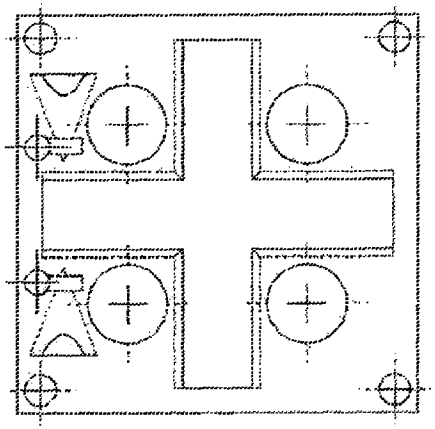
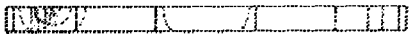
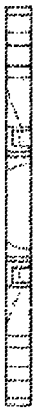

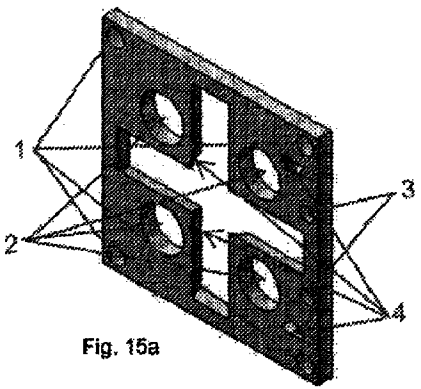
Fig. 15a
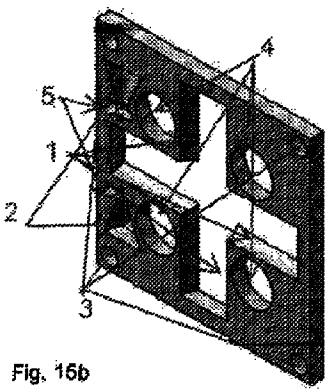
Fig. 15b
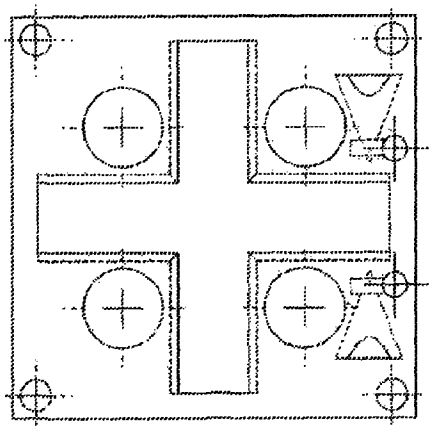
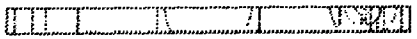
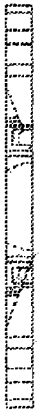

8
7
4
5
1
2
3

6
8
7
3
5
2
1
4

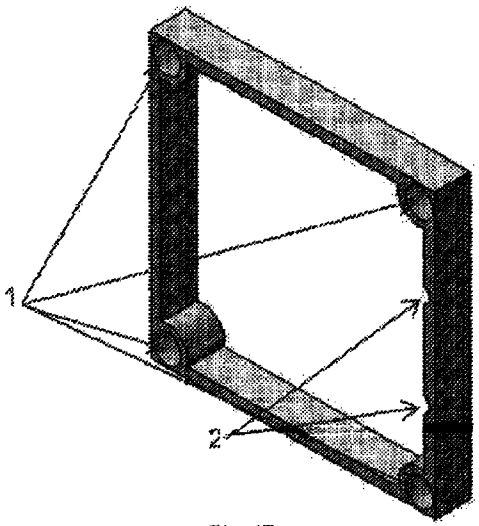
Fig. 17
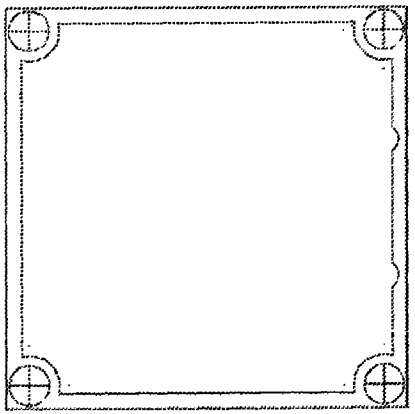
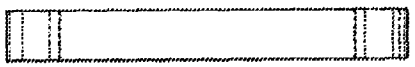
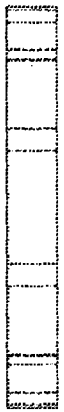

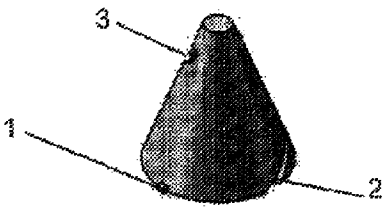
Fig. 19b
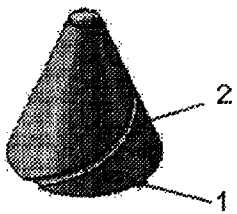
Fig. 19a
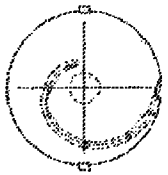
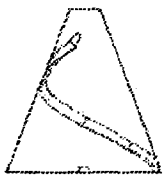
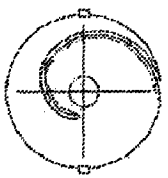
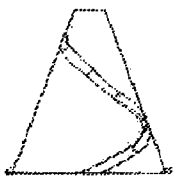

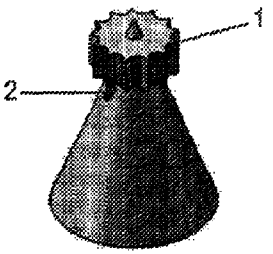
Fig. 20b
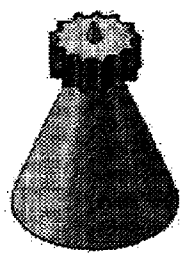
Fig. 20a
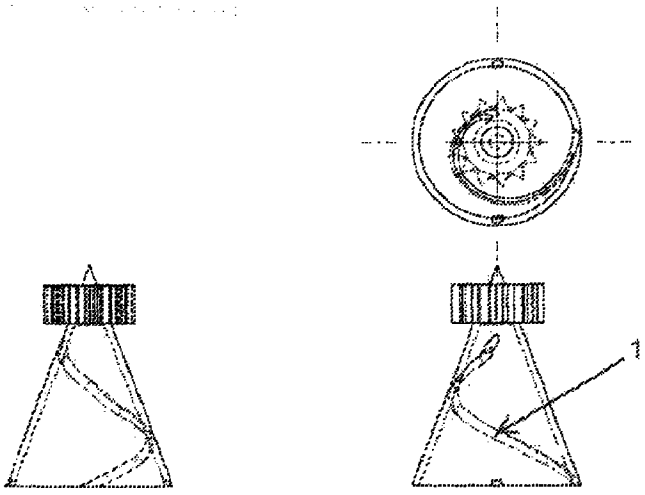
Fig. 20c
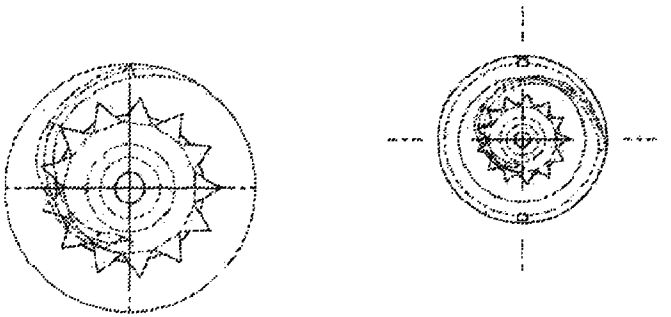

2
1

1
DETAIL A

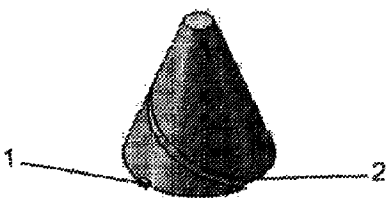
Fig. 22a
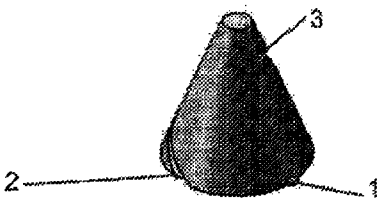
Fig. 22b
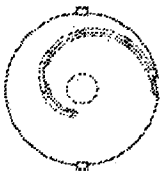
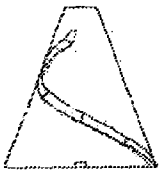
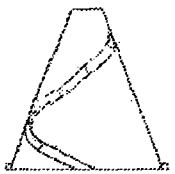
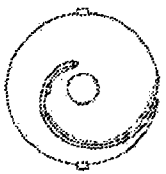

1

1
2

FLUID COUPLED HEAT TO MOTION CONVERTER (A FORM OF HEAT ENGINE) FCHTMC

CROSS REFERENCE OF RELATED APPLICATIONS

Not Applicable.

STATEMENT REGARDING FEDERAL SPONSORED RESEARCH

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

BACKGROUND OF THE INVENTION (1) This device relates to powerful, reliable, lightweight rotary power generators for personal breathing therapy such as oxygen therapy. Current battery and tank systems are too heavy and bulky, which limits the usability of these devices on public transportation without an attendant or tending cart. The weight of these devices also adds to the discomfort of the patient to pull or push the attending cart.

This device creates the possibility for debilitated patients to take public transportation, therefore, reducing the cost of their care. Conversely, another access that opens up is restaurants, courts and various entertainment venues, where the patient may use the regular means of conveyance without special consideration.

This device creates the possibility to construct a personal oxygen therapy device with weight less than one-half of a pound.

A way to supply undeterred power, using safely a cheap portable fuel such as Butane. A way to supply tethered power, using an electrical outlet or cigarette lighter plug inside of a vehicle. Particular attention is paid to safely burning butane in an explosion proof setting. This avenue also presents itself in mining. The specific material selected to construct this device does not only have dielectric properties that eliminate any possible spark; it also has physical strength, great durability, and impeccable stability at the temperatures of utilization within the device.

(2) The inventor is very familiar with internal combustion engines after many adventures in engine modifications and racing at the early age. The inventor enjoyed racing success after his blueprint modifications to engines, suspension, and electronics of four different automobiles to the chagrin of a later TV show of renegades driving a Road Runner. This knowledge influenced the inventor, who was careful not to copy any of the previous failings.

SUMMARY OF THE INVENTION

A desire to utilize caloric energy as the common bond between one or more diverse energy sources, such and Butane or Electrical energy, is why the quest to design this device began. Selecting a refrigerant to translate the caloric energy to vapor power was a natural choice, which also required to provide means to control the input, protecting from explosion or burning of the refrigerant. After several attempts it was settled to create the device entirely from a ceramic rather than from metal-ceramic combinations. The refrigerant life cycle is extended indefinitely, if there is no contact with metal. The divergent expansion rates between ceramic and metal were the final deciding factor. The entirely ceramic device offered several advantages without any distinct disadvantages. The ceramic is a caloric insulator, rigid structure, and homogenous entity without grain that supports the creation of load bearing surfaces by simple polishing of these surfaces. The ceramic thermal expansion is stable to temperatures well beyond those generated within the device. The device exhibits enhanced long-term durability, incredible stability, and the reversed power to weight ratio in comparison with known engines. All these features shall become apparent from a study of the following description and the accompanying drawings.

DRAWINGS

Figure 1:
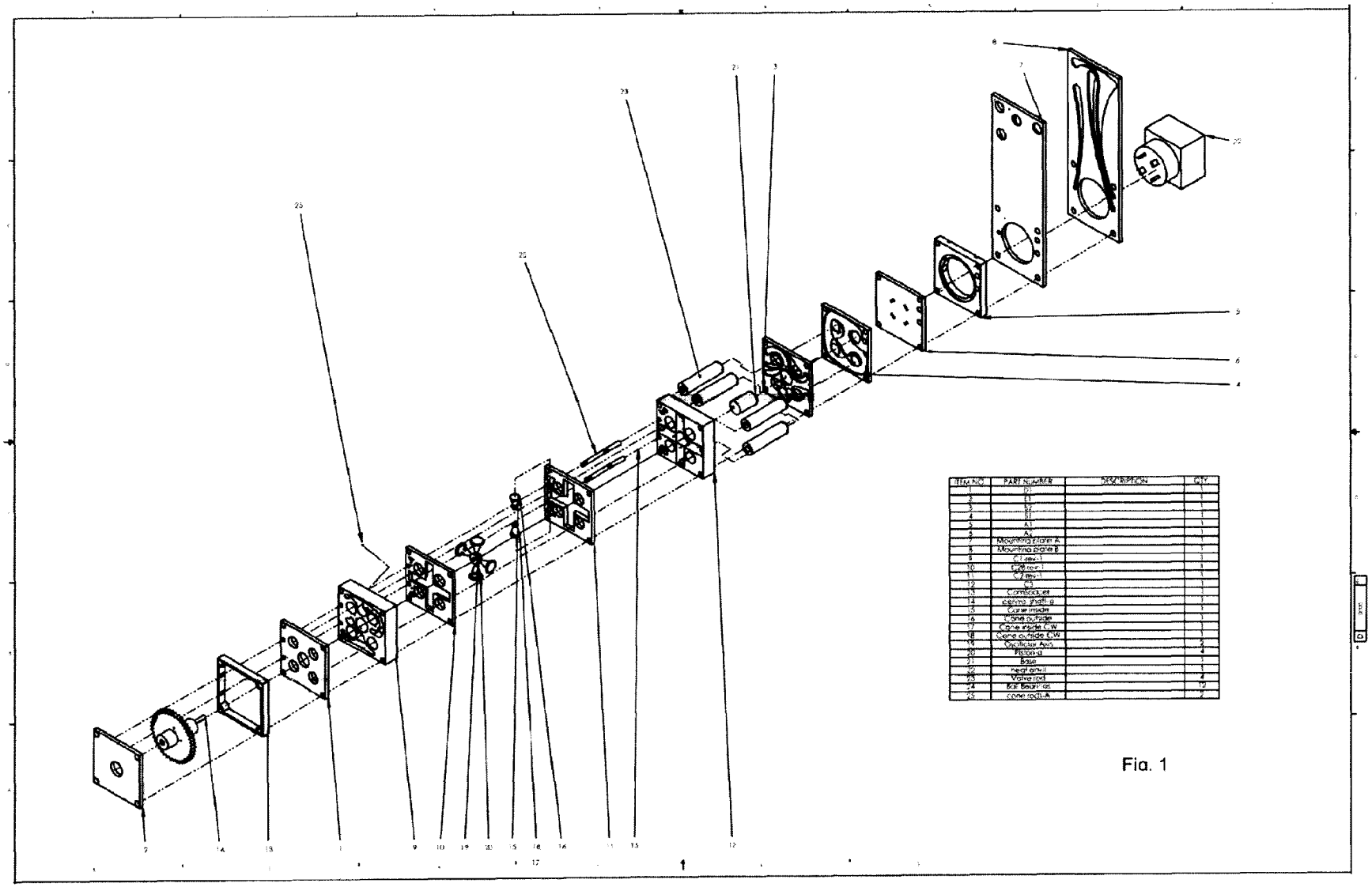
FIG. 1 is an exploded view of the Fchtmc device.

FIG. 5*a*: The D1 Plate Lower surface is illustrated. [a modified mirror of the C3 plate, (FIGS. 15*a-b*) upper surface]. This geometrical layout forms the remainder of the exhaust vapor routing conduit (1). This layer also provides gas-tight vapor seal surfaces for the mounting bolt circular through-cavities (2), also four seats are provided for the rotary expansion controls and the central output shaft (4), vapor pump drive rods (5). The illustration depicts the upper D1 plate surface (FIG. 5*b*): Termination of the rotary expansion device (1), the rotary expansion device driver motors sit atop this plate. These are small permanent magnet "stepper motors". There is one drive motor for each rotary expansion device. The illustration depicts circular through-cavities for the central shaft (2), four mounting bolts (3), and two drive rods (4).

Figure 6B:
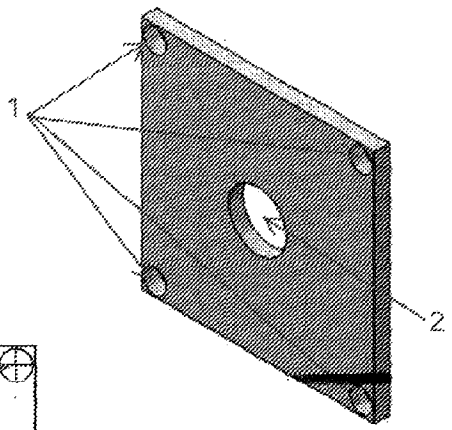
Figure 6A:
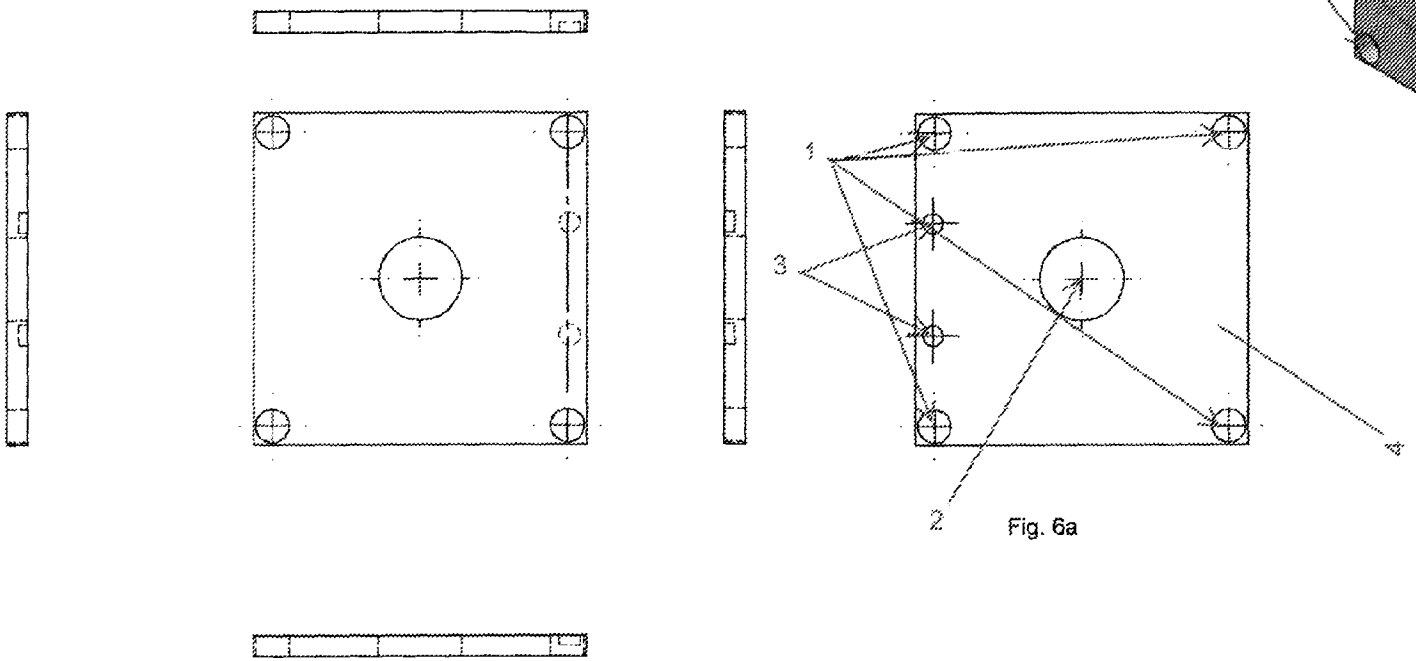

FIG. 6*a*: E1 Plate Lower surface is illustrated. The final upper layer of the device. The Vapor pump drive shafts seat into cavities inset into the bottom surface of this plate (3). It is not illustrated a gear integral to the central output shaft (2) drives smaller gears on the cone drive rods, which cause the vapor pump drive rods (3) to rotate. The illustrated top surface (FIG. 6*b*): It depicts the four circular through-cavities provided for mounting bolts (1), which terminate on the upper surface of the plate then hold the entire assembly together. A large bearing surface (2) provided for the central shaft that insures the stability necessary for a lengthy mechanical life. Furthermore, depicted are the two circular cavities providing cone drive rod seating surfaces (3) A backup hearing surface is provided for the integral gear top surface to ensure vertical stability of the central shaft (4).

FIG. 7*a*: The B2 Plate is illustrated. The lower surface forms the top section of the working fluid reservoir (1). Drawing details: Four circular through-cavities permit passage of the rotary expansion controls (2), which seat on the B1 layer. Item (3) four circular through-cavities permit mounting screw passage. Item (4) the vapor-transport conduits, the liquid return working fluid conduit terminates on the previous layer. The vapor conduit to the heat exchanger originates on this layer (5). At each cone drive rod (2) geometrical routing (6) guides the vapor produced into the upper B2 layer. The B2 upper surface (FIG. 7*b*) the central shaft base (FIG. 25) seats on this layer (8). Four circular through-cavities (9) allow the rotary expansion device to proceed to the B1 layer. The cone drive rods seat on the B2 layer (10) the exhaust vapor guided to the vapor return circular cavity (11). The caloric reaction vapor guides channel the vapor to the input port of each cylinder. Four circular through-cavities (7) provide the mounting bolts to proceed through to the plate C1.

Figures 8A, 8B:
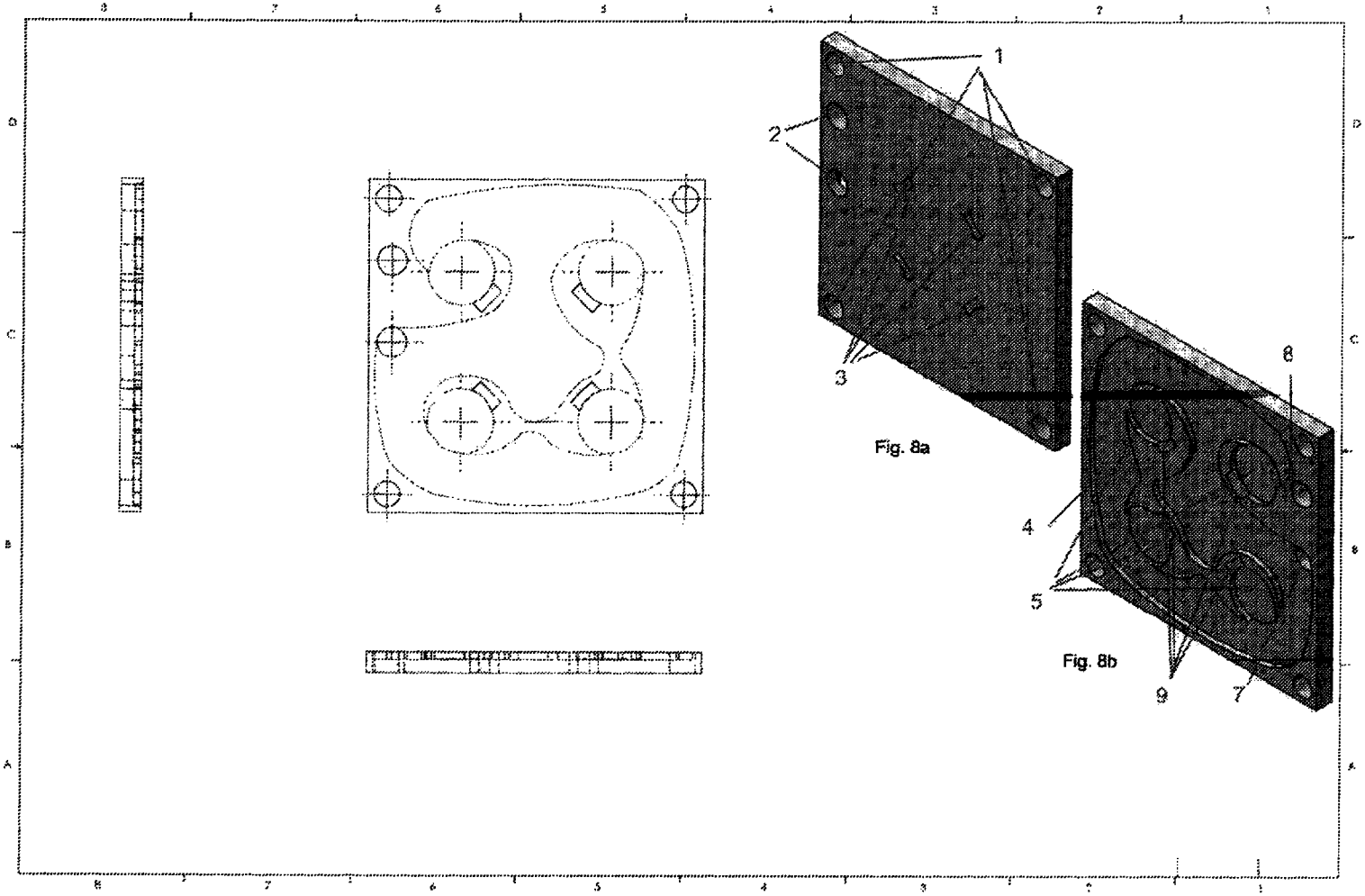

FIG. 8*a*: The B1 Plate lower surface is illustrated. The Heat-Anvil calorie conductor element (3) is pressed-tightly into the (B1) plate, providing a gas-tight connection. Further illustrated are the four mounting screws pass through circular cavities (1). Two circular through-cavities (2) communicate vaporous and liquid working fluid to and from the B1 B2 interface layer. FIG. 8*b*, illustrates the upper-surface of B1 plate, the working fluid pre-evaporation cell. A larger sealed cavity is formed between the B1 & B2 plates (4). The liquid working fluid confined inside this large gas-tight structure is passive. Rotary expansion control seat (5) supports the rotary expansion control laterally [one working fluid control of valve rod per oscillator bank], the caloric conductor element entry (3). Evaporation of working fluid occurs when a rotary-expansion-control fluid cup transports a droplet of working fluid 180 degrees from the fluid storage area to the evaporation cell. The area between the rotary expansion device and the caloric conductor element creates an evaporation cell (9). Liquid working fluid is injected into the storage cell at this point (7). Working fluid vapor is conducted to the adjacent layer in this conduit (8).

Figure 9:
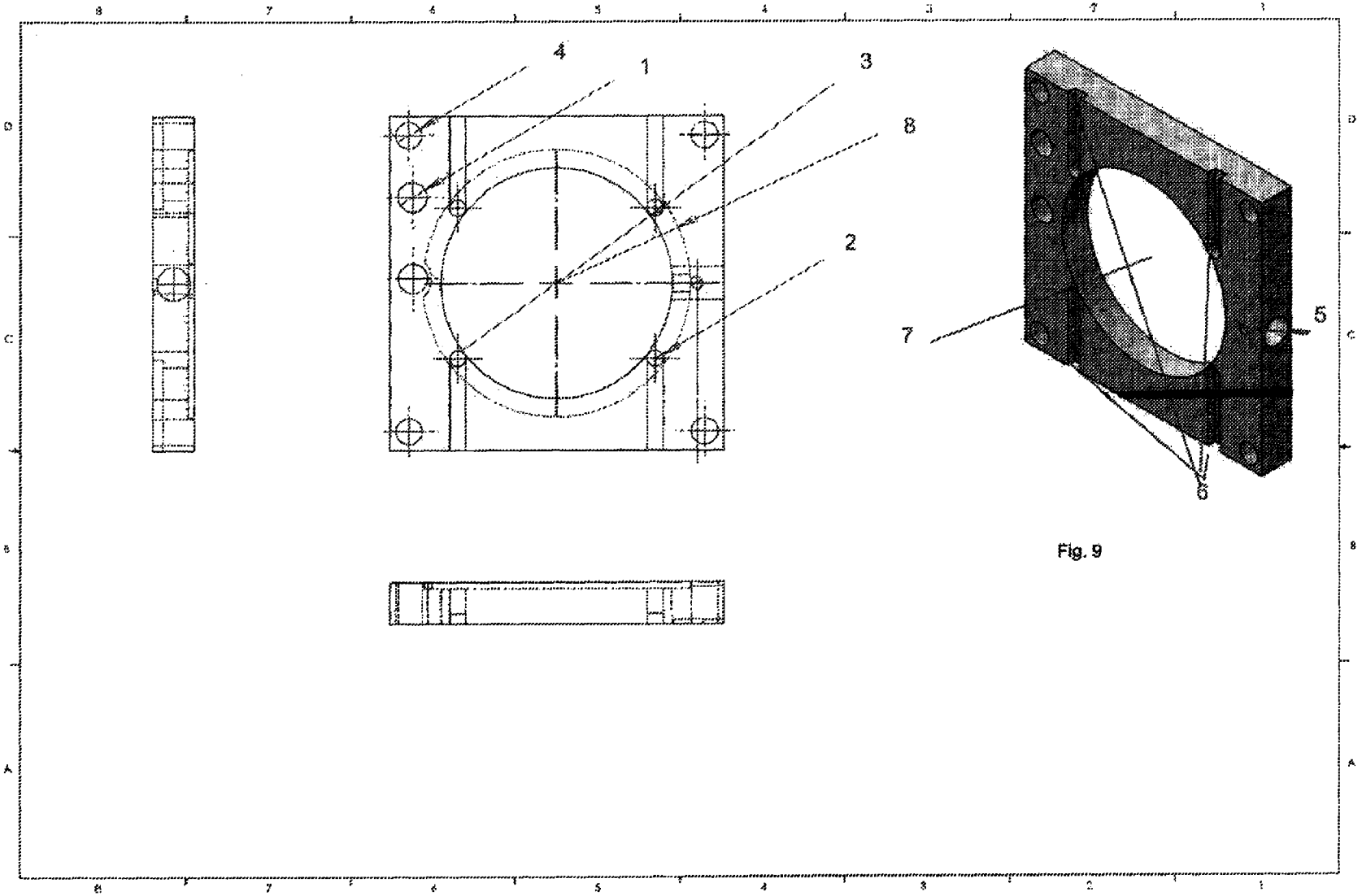

FIG. 9: The A1 plate is illustrated, the design, and construction of the (A1) vapor fuel burner plate [heat source]. This is not the only possible energy source for the invention, but is representative of one method of providing caloric input into the invention. The illustrated burner plate consumes evaporated fuel to provide a caloric-input source. The illustration displays the lower surface of A1. The Illustrated item (7) depicts the large circular cavity through which the turret of the Heat Anvil proceeds. The illustrated item (4) depicts the four through circular cavities for a mounting screw, the two circular cavities, for vapor/liquid working fluid. Shown, on the right side is the air-intake cavity (5) for the burner. Item to the immediate left of the air-intake cavity on the bottom surface is the fuel inlet cavity. Item (6) depicts the four slots, which allow the Combustion exhaust gas to escape from the combustion ring through the exhaust cavities (2) then under the (A1) plate in the channels to the air. On the upper surface of (A1), the combustion ring (8) is a circular groove fed by a fiber matrix at the inlet to promote highly efficient confined and continuous flame burning. The fiber-matrix provides even and complete combustion with guaranteed minimal CO NOX effluents. Four-exhaust port (2) provides an exit for exhaust gases to the free air or to a collector as necessary. The caloric transfer is by direct infrared radiation & exhaust gas convection to the Heat Anvil Turret that is immediate to the fuel combustion ring (8). Four circular through-cavities provide (4) a passage for the mounting bolts. The central circular cavity (3) provided to allow the turret of the Heat-Anvil to pass through to the A2, (FIG. 10) plate. Other heat sources, such as solar, electrical or geothermal are possible in addition to fuel.

Figure 10:
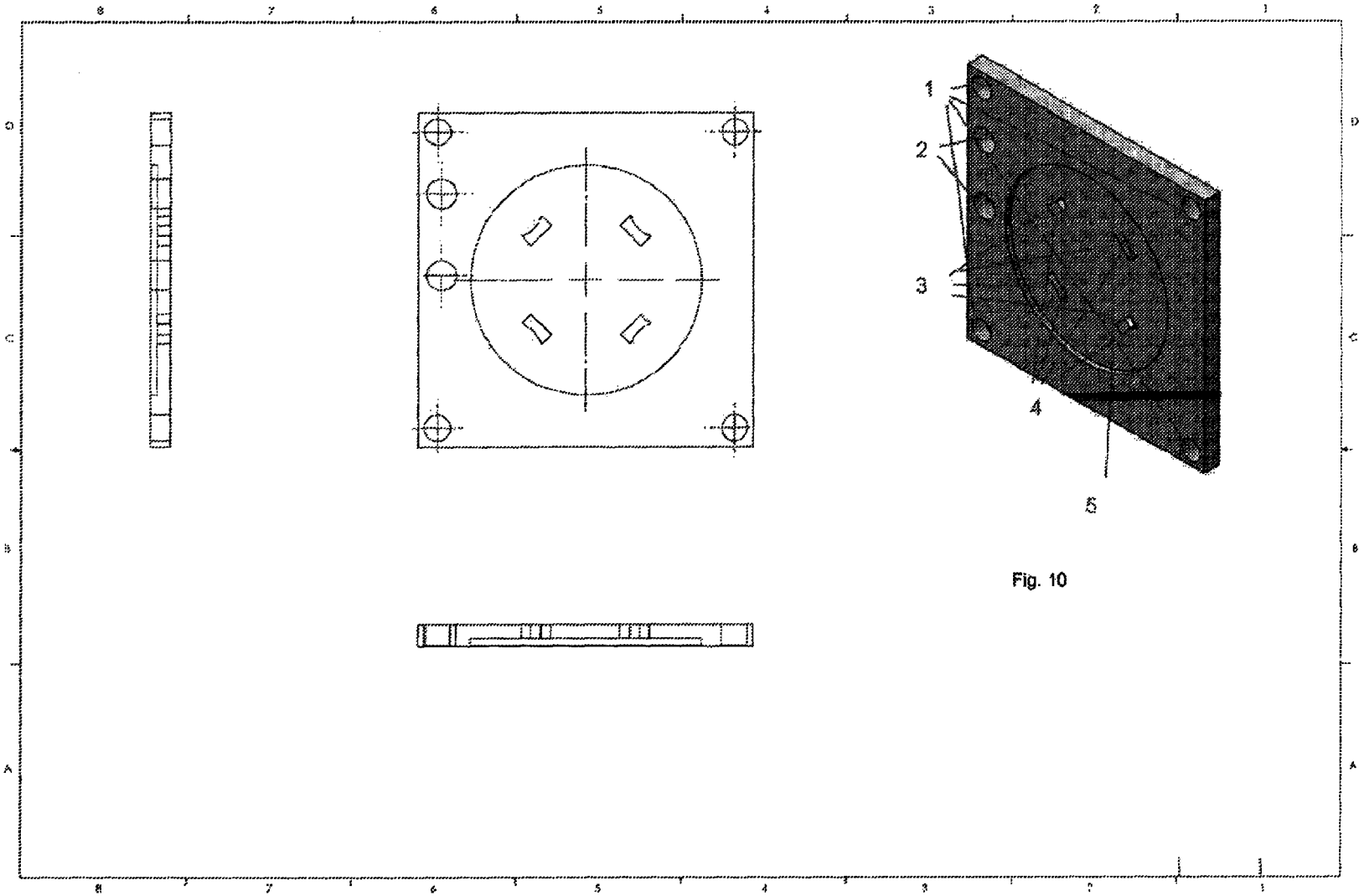

FIG. 10: The Heat-Anvil mounting plate (A2). The illustration depicts the lower surface of A2. The Heat-Anvil Turret seats into the bottom of A2 (5). The caloric conductor elements of the Heat-Anvil are close communication with the A2 plate where they form the hot-spots. The caloric conductor elements have a concave surface to interface with the circular body of a rotary expansion device. The caloric conduction element is necessary to communicate caloric energy into the invention. Two circular cavities (2) provide through communicate of vaporous and liquid working fluid to and from the mounting plate to B1 FIG. (8*a-b*) plate.

Figures 11A, 11B:
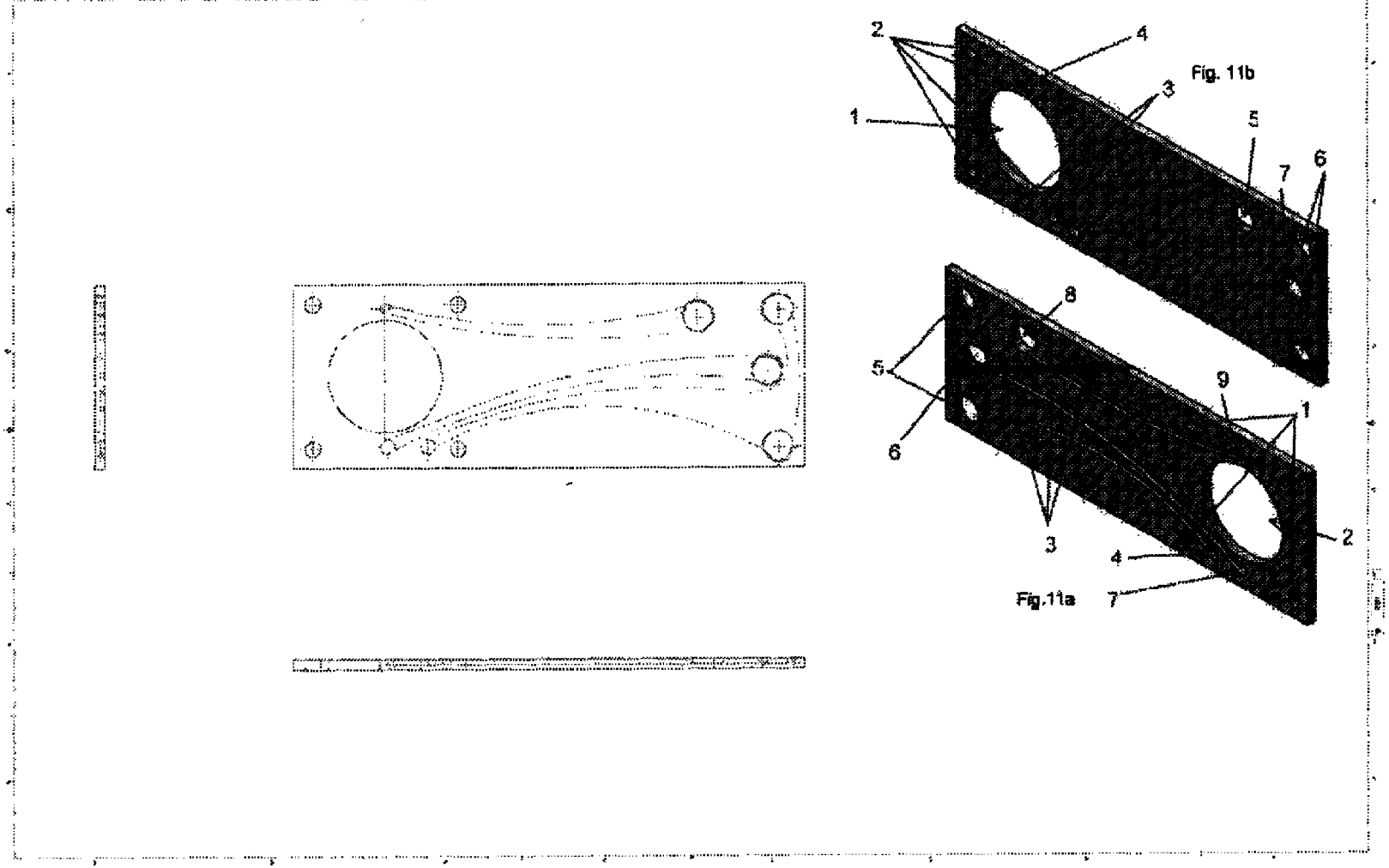

FIG. 11*a*: The illustrated depicts mounting plate A, lower surface. Furthermore, illustrated is the large circular through-cavity for the Heat-Anvil turret (1), There is also illustrated the four circular through-cavities for the screws (2). Furthermore, illustrated are geometrical cavities (3). Furthermore, illustrated is the fuel feed circular cavity (4). On the opposite, end the vaporized fuel inlet (5). In addition, it is depicting the heat exchanger input (6), and the heat-exchanger output (7). The lower surface of mounting plate B is illustrated in (FIG. 11*b*) this depicts the large circular cavity (1) providing for the turret of the heat-Anvil, FIG. (26). Furthermore, illustrated are the through-cavities for the four mounting-screws (2). Two circular-cavities (3) provide for working-fluid transition to the geometric channels formed on the lower-surface of the plate ((FIG. 11*a*)(4,7)). A circular-cavity is provided (4) for fuel transition from the geometrical channel formed on the lower-surface of plate A ((FIG. 11*a*)(9)). A through circular-cavity (5) is provided for mounting the fuel control mechanism. Two circular-cavities are illustrated (6) that provide to mount the heat-exchanger then direct depleted working-fluid transitioning in a geometrical channel ((FIG. 11*a*)(4)) to the heat-exchanger (Not illustrated). A single circular-cavity (7) is provided to direct liquid working-fluid (7) to the geometrical channel on the lower-surface of the plate ((FIG. 11*a*)(7)).

Figure 12:
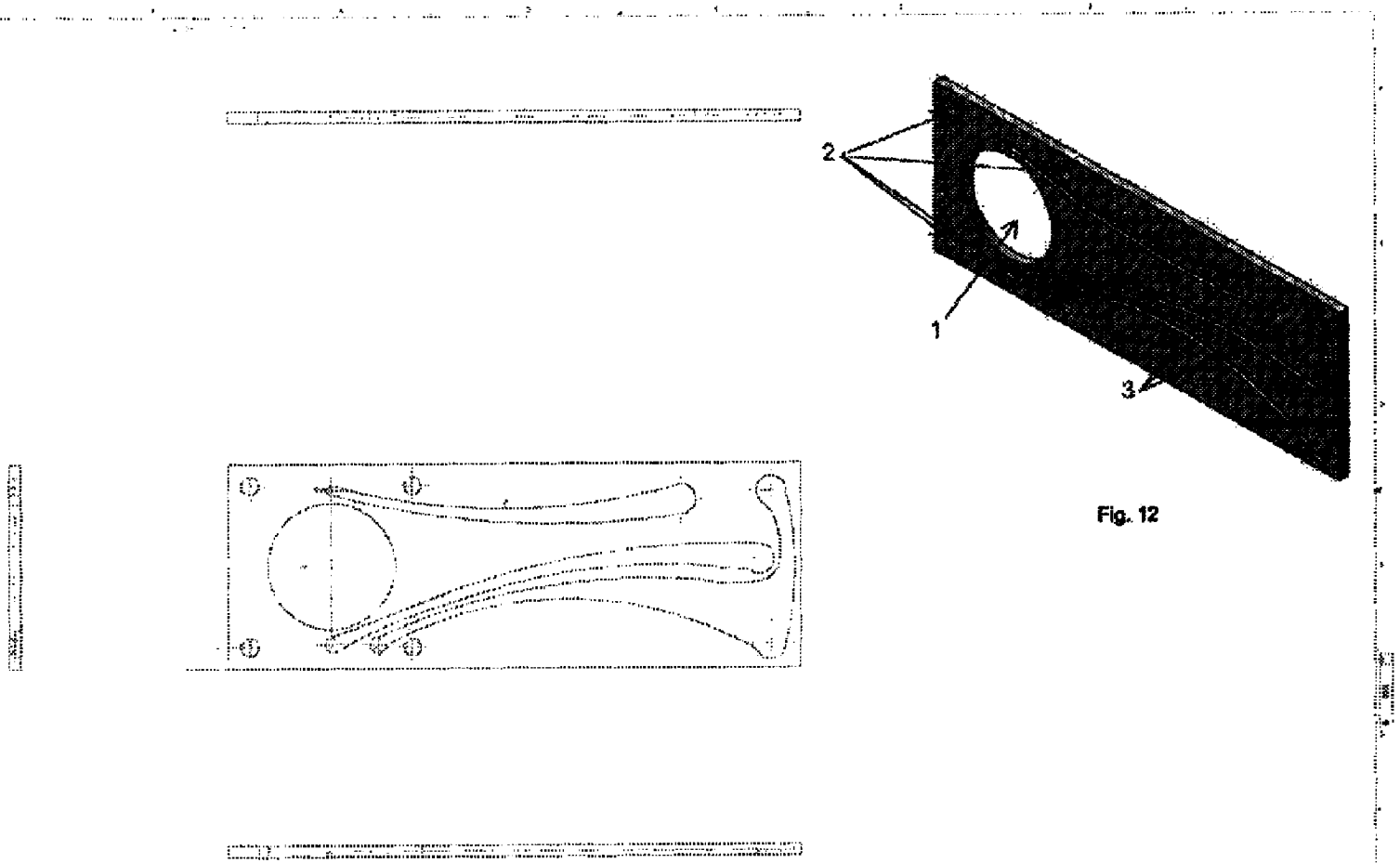

FIG. 12: Illustrates the upper surface of mounting plate B: The illustration depicts a circular through-cavity for the heat anvil turret (1). The four mounting screws terminate into threaded inserts pressed tightly into the circular through-cavities that attach the mounting screws securely (2). There is geometrical routing mirroring the lower surface of mounting plate A, FIG. (11*a*)(3). The lower surface of mounting plate B has no remarkable enhancements.

FIG. 13*b*: Illustration depicts the C1 Plate lower surface (FIG. 13*b*): Circular through-cavities for mounting bolts (1), in addition, circular through-cavities for each working fluid inlet control (rotary expansion device) (2). The illustration depicts the circular-cavity cylinder vapor input conduits (3) guide vapor into each cylinder. The illustration depicts a circular through-cavity permitting central shaft (7) passage. Each cylinder represented by a channel (6), which represents ⅓ of the confining structure for a piston, FIG. (24). In addition, ⅓ confinement provides tar both compressor cones (2), FIG. 19*a-b*), FIG. (21*a-c*)]. The four circular through-cavities for mounting bolts (1). The illustration depicts the cylinder vapor inlet ports (3). The illustration depicts circular through-cavities permitting Rotary Expansion Device (2) passage. The illustration depicts the through-cavity permitting central shaft (7) passage. Cone compressor drive rod circular through-cavities (5). The C1 plate upper-surface (FIG. 13*a*) depicts four circular through-cavities permitting passage of the caloric-expansion devices (2), and four through circular cavities permitting the mounting bolt passage (1), the cylinder vapor inputs (3), and the two circular through-cavities permitting passage of the cone-drive-rods (4).

FIG. 14*a*: Illustrates the C2A Plate lower surface: Circular through-cavities for mounting screws (1), Valve Rods (2), Cone Drive Rods (3). The upper surface (FIG. 14*b*) also contains ⅛ of the central geometry to contain the pistons and cones (1). The illustration depicts four through-cavities for mounting bolts (2), and the rotary expansion device (3) and two circular through-cavities permitting cone drive rod (4) passage.

FIG. 15*b*: Illustrates the C2B Plate upper surface: Circular through-cavities for mounting bolts (1), Rotary expansion device (2), Cone Drive Rods (3), the Cone geometry completes on this surface (4). The Lower surface (FIG. 15*a*) also contains ¼ of the central geometry to contain the pistons (1) and cones (2). Through circular cavities continue the paths of the mounting bolts (3), rotary expansion device (4) and cone drive rods (5).

Figures 16A, 16B:
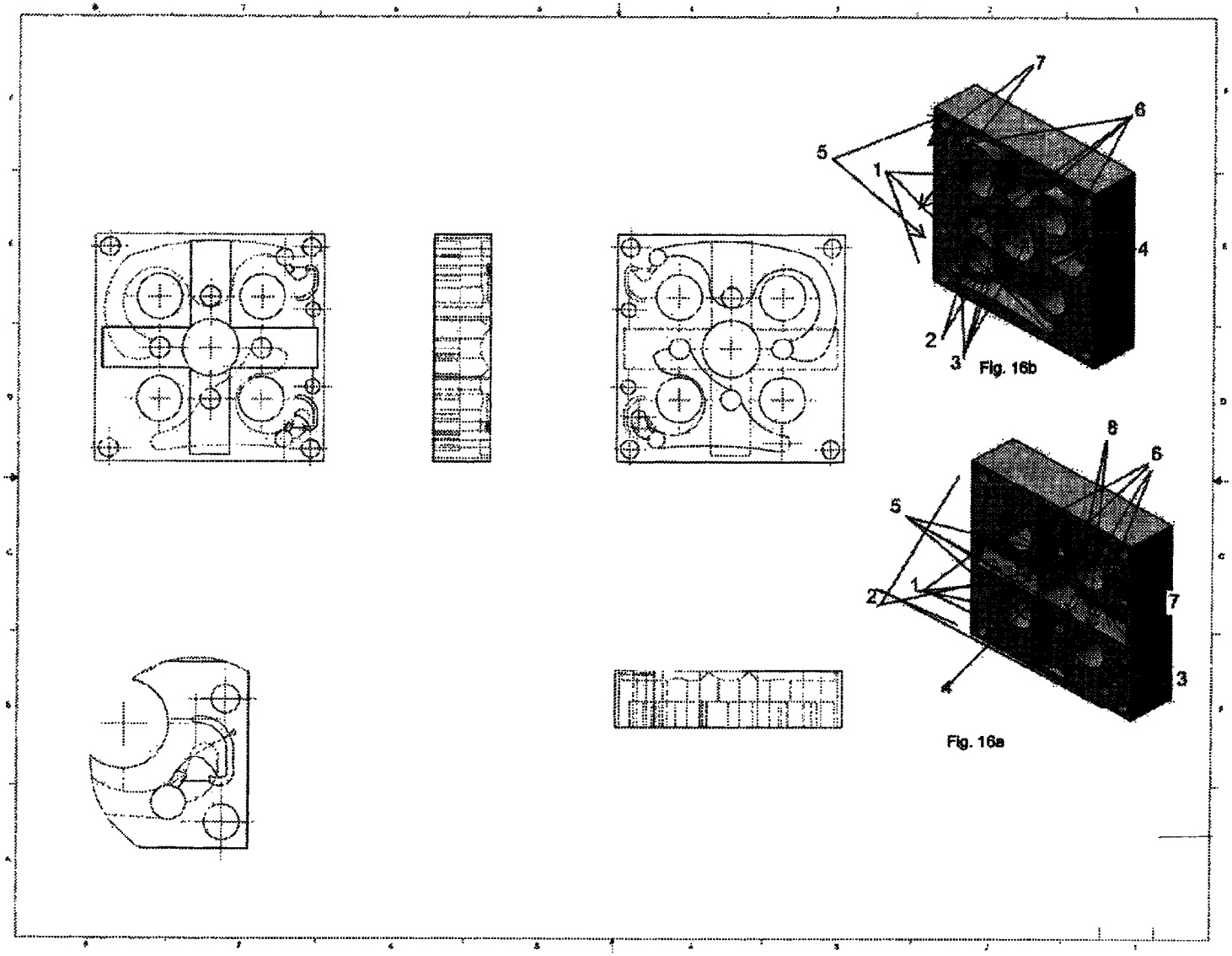

FIG. 16B: Illustrates the C3 Plate upper-surface: Four Circular through-cavities for the rotary-expansion device (1), and the mounting-bolts through-circular cavities (2). Vapor pumps drive shafts (3). The illustration depicts the central output shaft second bearing surface (4), the geometrical exhaust routing (5). This plate forms the upper ⅙ cavity for each oscillator piston, (FIG. 24)(6). Upper vapor pump cavities with ball track (7) (see Detail A). The working fluid exhaust conduit and ports (8). The illustration depicts the C3 plate lower surface (FIG. 16*a*). The mounting bolt circular through-cavities (1). The illustration depicts the upper conduits to buffer and direct exhaust working fluid vapor from each of the four-oscillator quadrants (2) the exhaust ports (3) communicate to the exhaust transfer conduit (5). Four circular through-cavities (6), and the vapor pump drive rods (7), the central shaft circular through-cavity (4).

FIG. 17: Illustrates the Spacer. This spacer establishes a confined space within which the interface electronics and components necessary to sense and control the device components are mounted. It is not illustrated is the rotational index sensor electronics for the central output power shaft A permanent-magnet dynamo style internal generator is located within this space, driven by permanent magnets mounted on the underside of the central shaft gear. This small internal electrical generator provides power to the PLC associated control electronics. Furthermore, illustrated are the four circular through-cavities that are provided for the mounting bolts (1). Furthermore, illustrated are two ½ circular through-cavities provided for the cone drive rods (2).

Figures 18A, 18B:
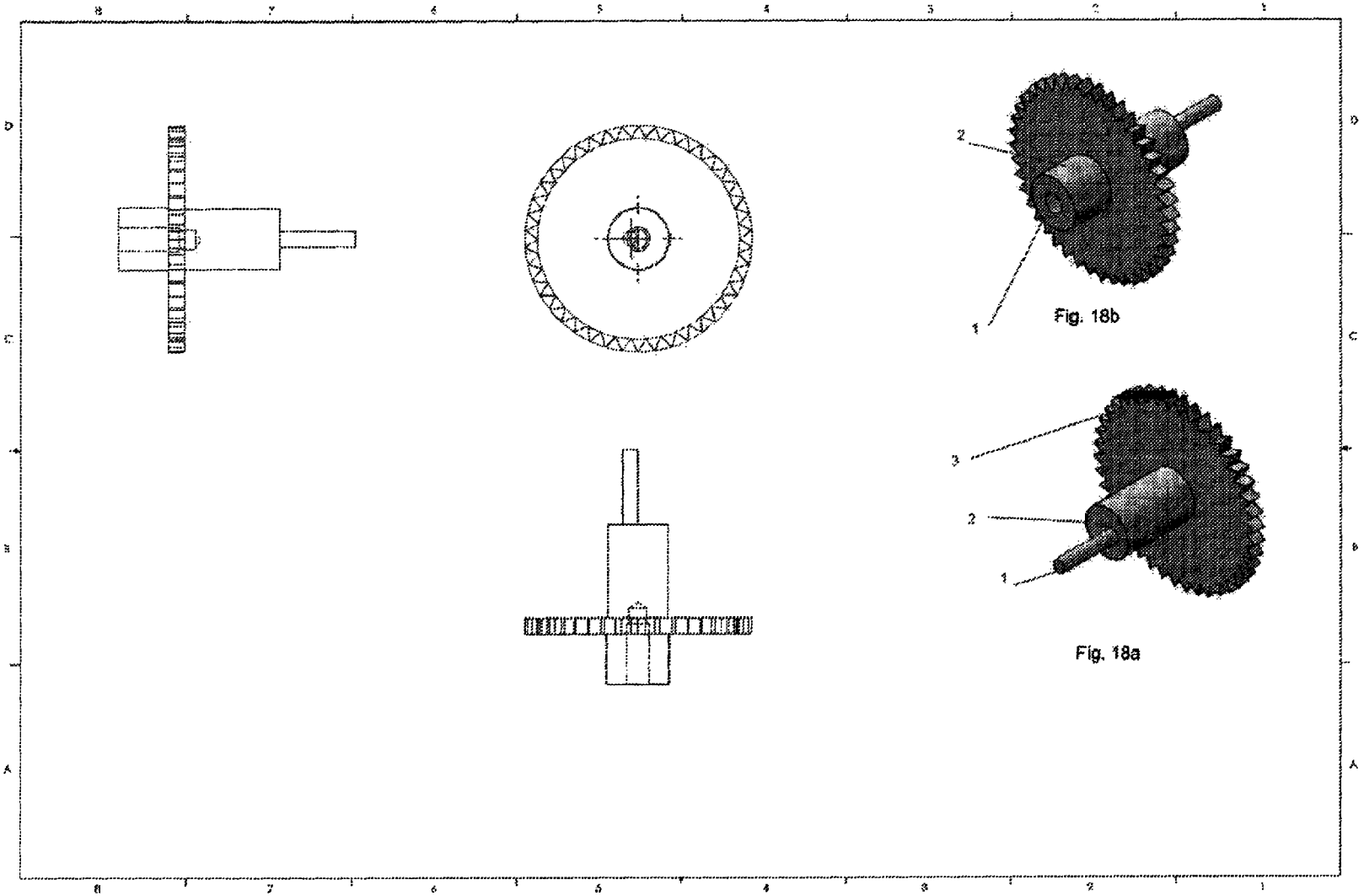

FIG. 18*a*: Illustrates the Central Shaft: The central shall bottom view (FIG. 18*a*) central-shaft transfers rotational energy from the oscillator to the internal components and to work outside. The pin (1) fits into the circular through-cavity on the oscillator plate, FIG. (23) then into the main shaft base, FIG. (25). The base of the central shaft (2) presses onto the top oscillator plate holding it secure. The gear (3) transfers rotation energy to the drive rod of the cone compressor.

The central shaft top-view (FIG. 18*b*) illustrates the final bearing surface (2) combines with the E1 plate, FIG. (6*a-b*) to steady the main shaft. A 6/32-screw insert (1) provides for attachment of various pulleys and chain sprockets or direct coupling.

FIG. 19*a*: This illustration depicts the CCW Cone Internal: The illustration depicts the Counter-Clockwise Internal Cone. One-half (0-180 degrees) of the cone is illustrated (FIG. 19*a*) illustrated are the index tab (1), the beginning of the geometrical spiral track (2) designed to allow a centrifugal force to push the ball through the track. Therefore, this decreasing radial diameter is forcing compression through acceleration. The final portion of the spiral track is illustrated (FIG. 19*b*(3)). One-half (181-360 degrees) of the cone is illustrated indicating the second index tab (1) and the remaining portion of the spiral track (2).

FIG. 20*b*: Illustrates the CCW Cone Outer: Counter-Clockwise External Cone. One-half (0-180 degrees) of the cone is illustrated in (FIG. 20*b*). The gear to interface with the cone drive rod (1). The illustration depicts the ball exit through a circular cavity (2), balls encounter the truck built into the bottom surface of plate C3, (FIG. 16*a-b*) to be in sequence re-inserted into the track-pushing vapor in front of it. The vapor is pushed down the cone drive rod circular conduit. The cone has an internal track (FIG. 20*e*), (1) to mirror the track of the inner cone. The two pieces form a completely circular channel for the balls to navigate. The remainder of the cone (FIG. 20*a*) is without special consideration.

Figures 21A, 21B, 21C:
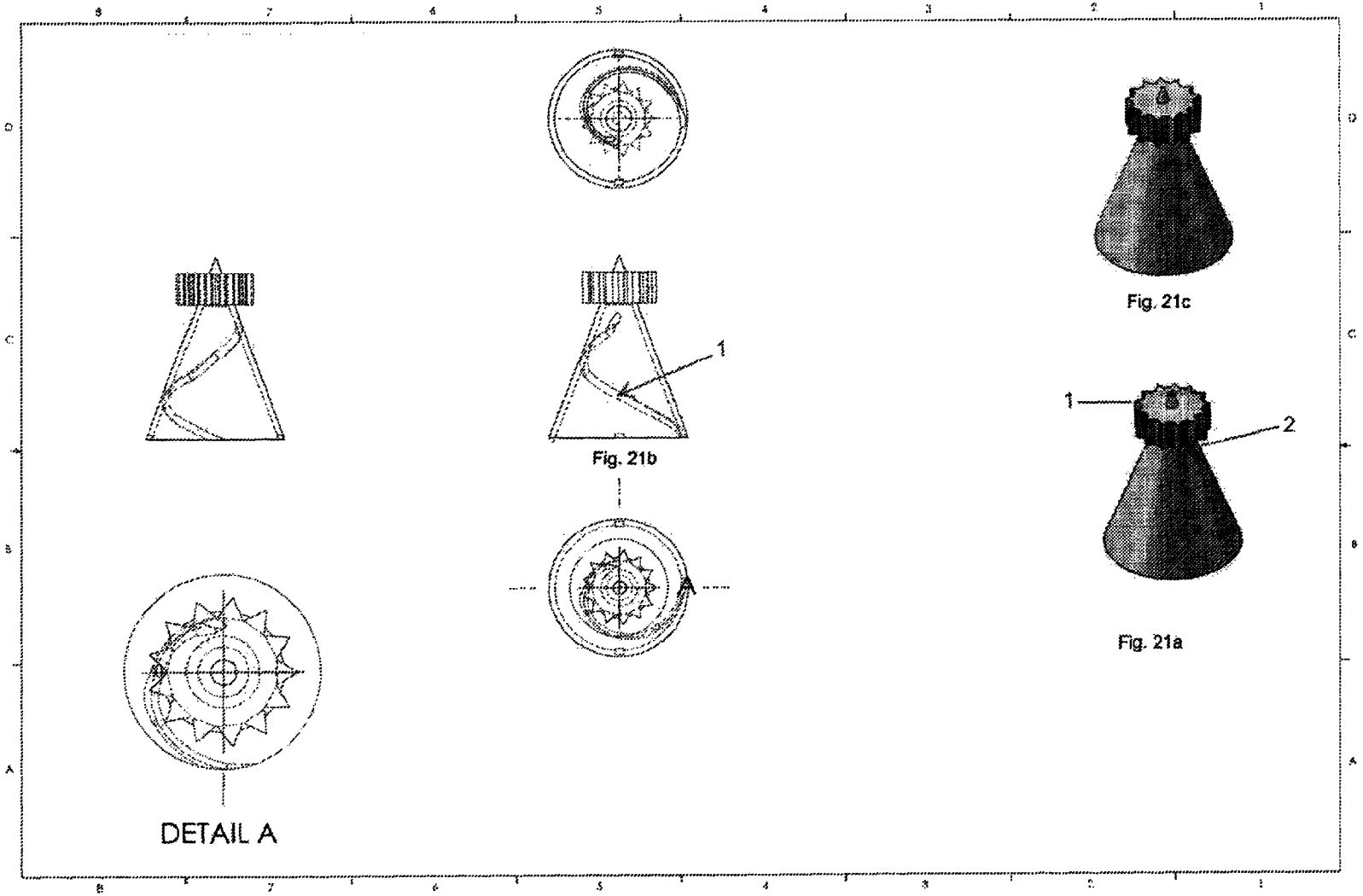

FIG. 21*a*: Illustrates the Cone Outer: Clockwise External Cone. One-half (0-180 degrees) of the cone is illustrated (FIG. 21*a*). The gear to interface with the cone drive rod (1). The exit through a circular cavity (2) for balls then the balls encounter the track built into the bottom surface of C3, (FIG. 16*a-b*) to be in sequence re-inserted into the track-pushing vapor in front of it. The cone has an internal track (FIG. 21*b*), (1) to match the track in the inner cone. The two pieces form a completely circular channel for the balls to navigate. The remainder of the cone (FIG. 21*c*) is without special consideration.

FIG. 22*b*: Illustrates the CW internal Cone. The Illustration depicts one-half (0-180 degrees) of the cone (FIG. 22*b*) indicating the index tab (1). The beginning of the geometrical track (2) designed to allow a centrifugal force to push the ball through the track forcing compression, then end of the track (3). One-half (181-360 degrees) of the cone is illustrated (FIG. 22*a*) indicating the second tab (1) and the beginning portion of the track (2).

Figure 23:
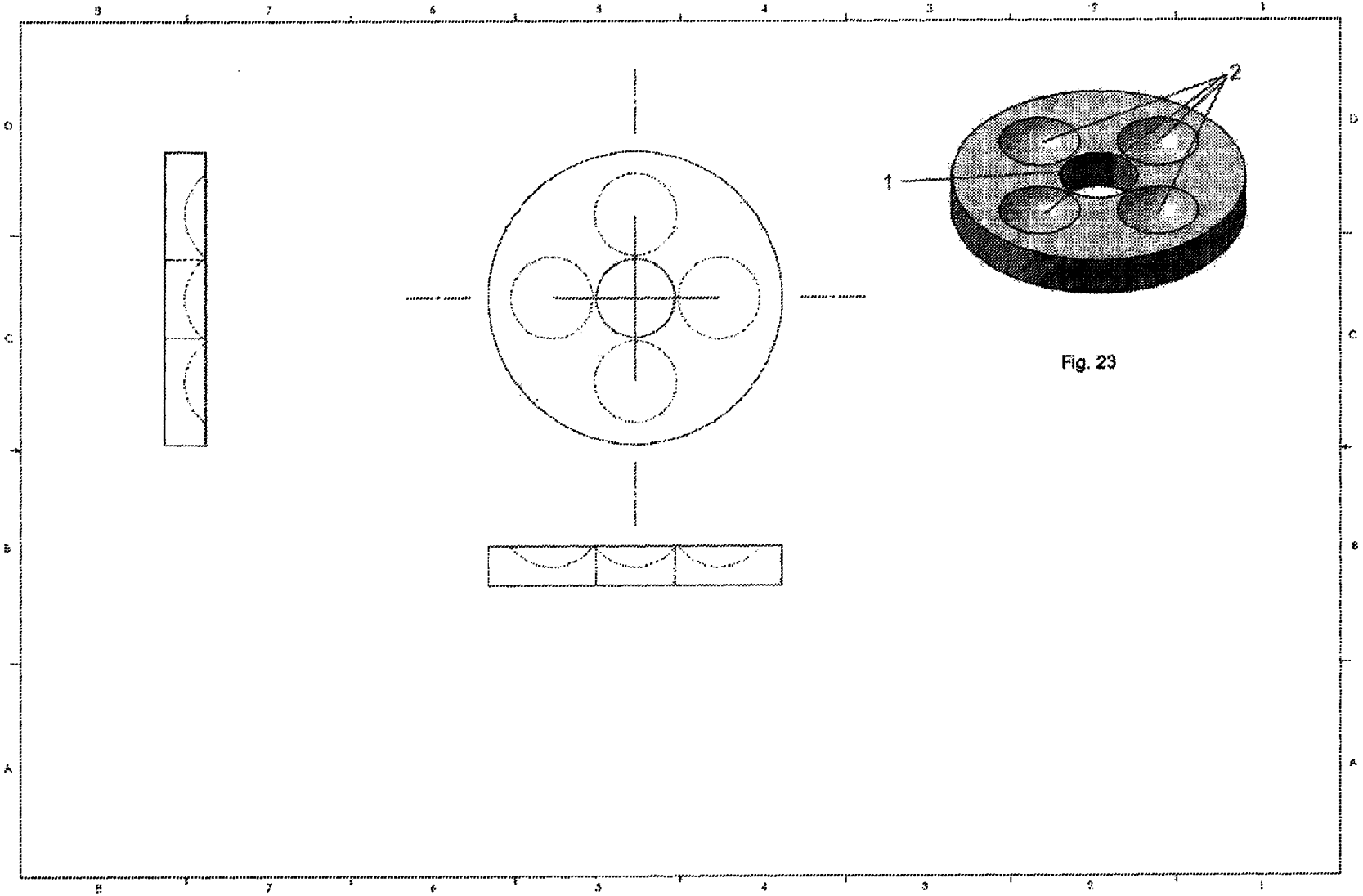

FIG. 23: Illustrates the oscillator Plate: The oscillator plate (FIG. 23) is used to secure the piston ends then to interface the entire assembly to the main-shaft offset pin. Features are: The illustration depicts the central circular through-cavity for the main-shaft offset pin (1), one of four ¼-spherical cavity (2) where piston balls, (FIG. 24) are retained when two (FIG. 23) plates are placed together with the four individual ball ends of the pistons a secure union is established.

Figure 24:
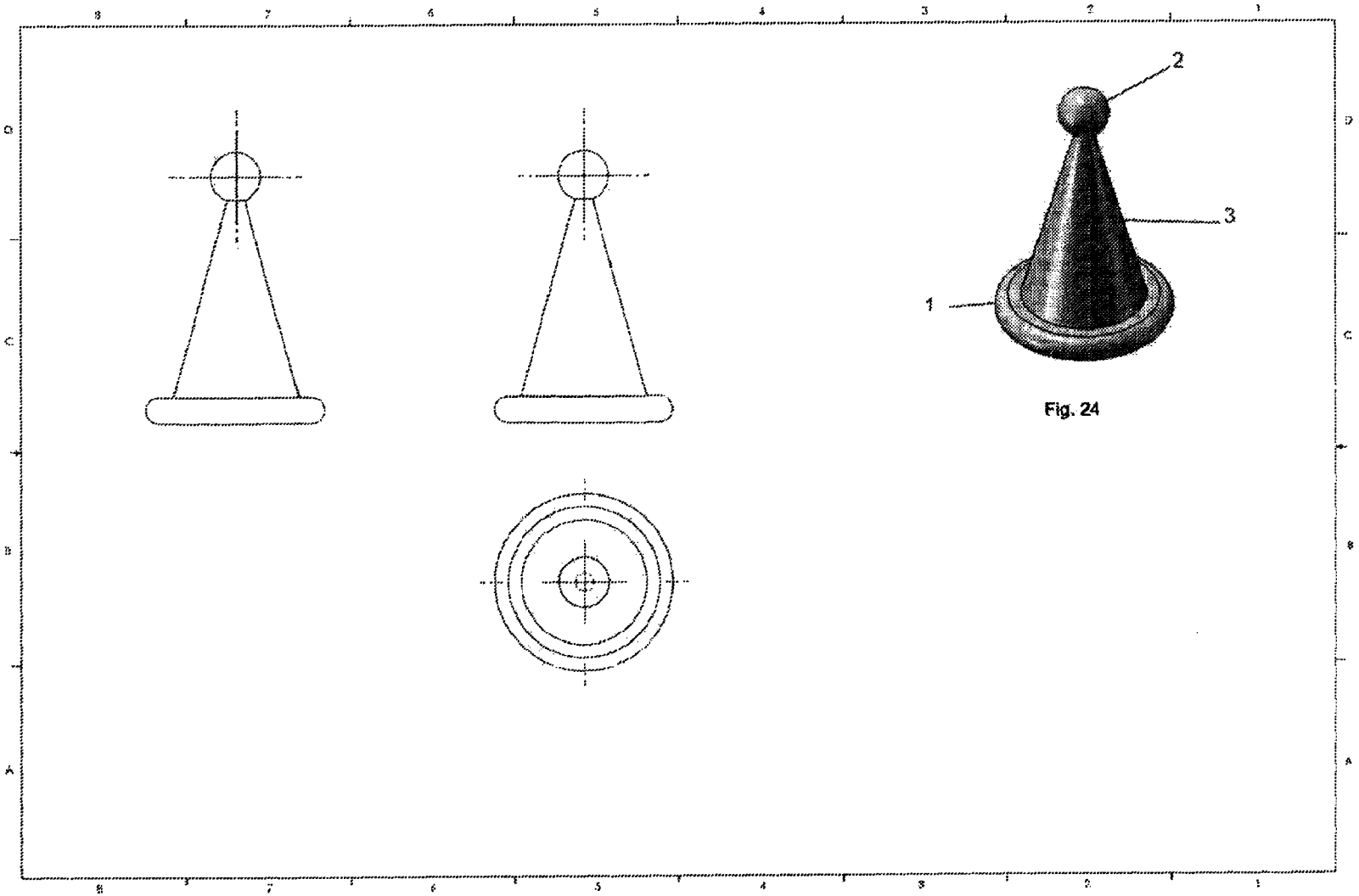

FIG. 24: The illustrations depicts the piston which is the second operative within the engine. The forward edge is rounded (1) to facilitate angles in the cylinder during complex motions due to the offset of the main-shaft pin and the common oscillator plate arrangement. The triangle (3) body shape is to take the most advantage of strength provided through linear angles. The ball (2) interface allows a multiple axis of free movement.

Figure 25:
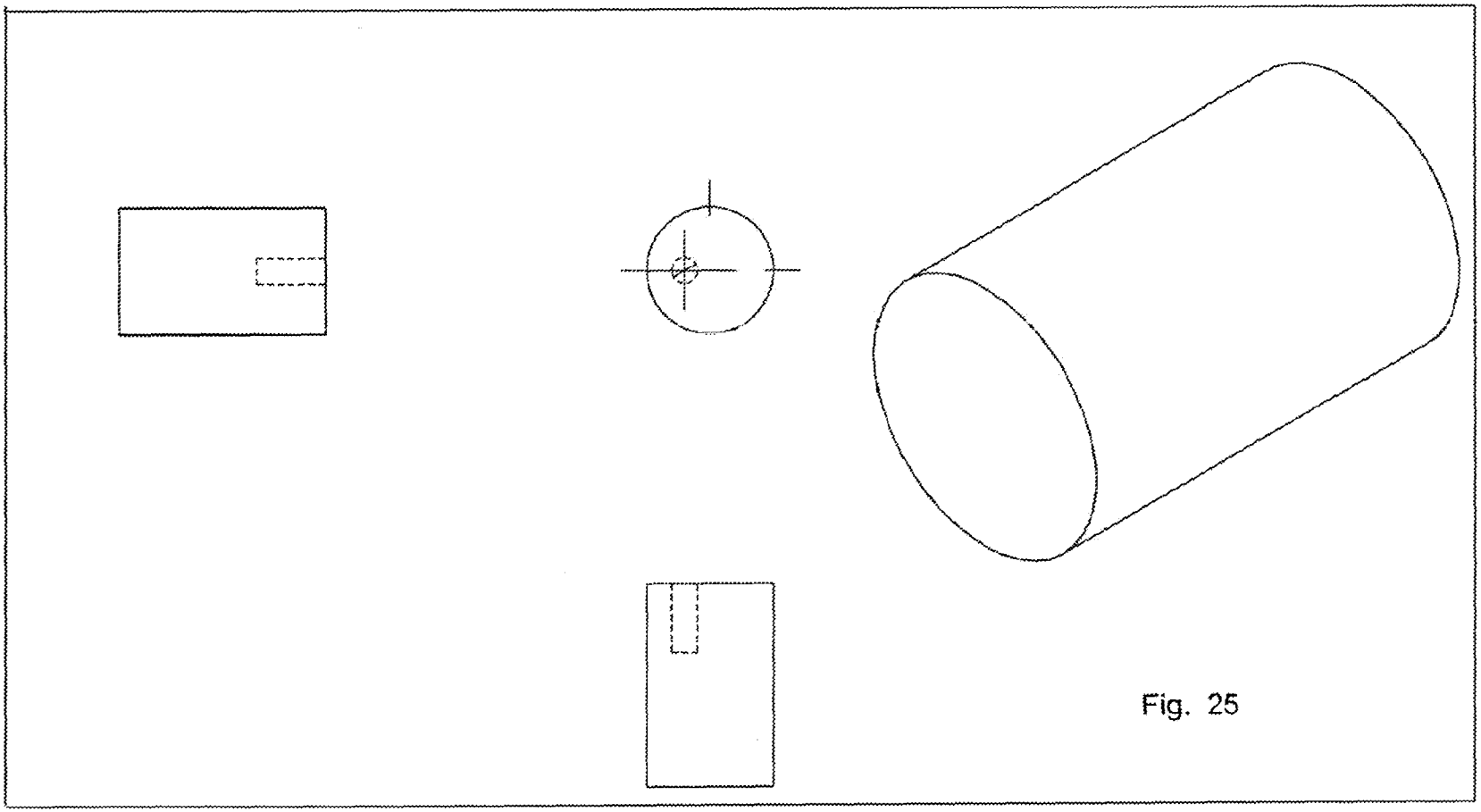

FIG. 25: Illustrates the Main Shaft Base: The main shaft base supports the bottom oscillator plate, (FIG. 23) on its the upper surface (2). The base is intersected by the main-shaft pin, (FIG. 18*a*), (1) which aligns the base and turns the base on it's axis to follow the main shaft. The bottom of the main shaft base (1), seats into the area provided on the B2 plate, (FIG. 7*a-b*).

Figure 26:
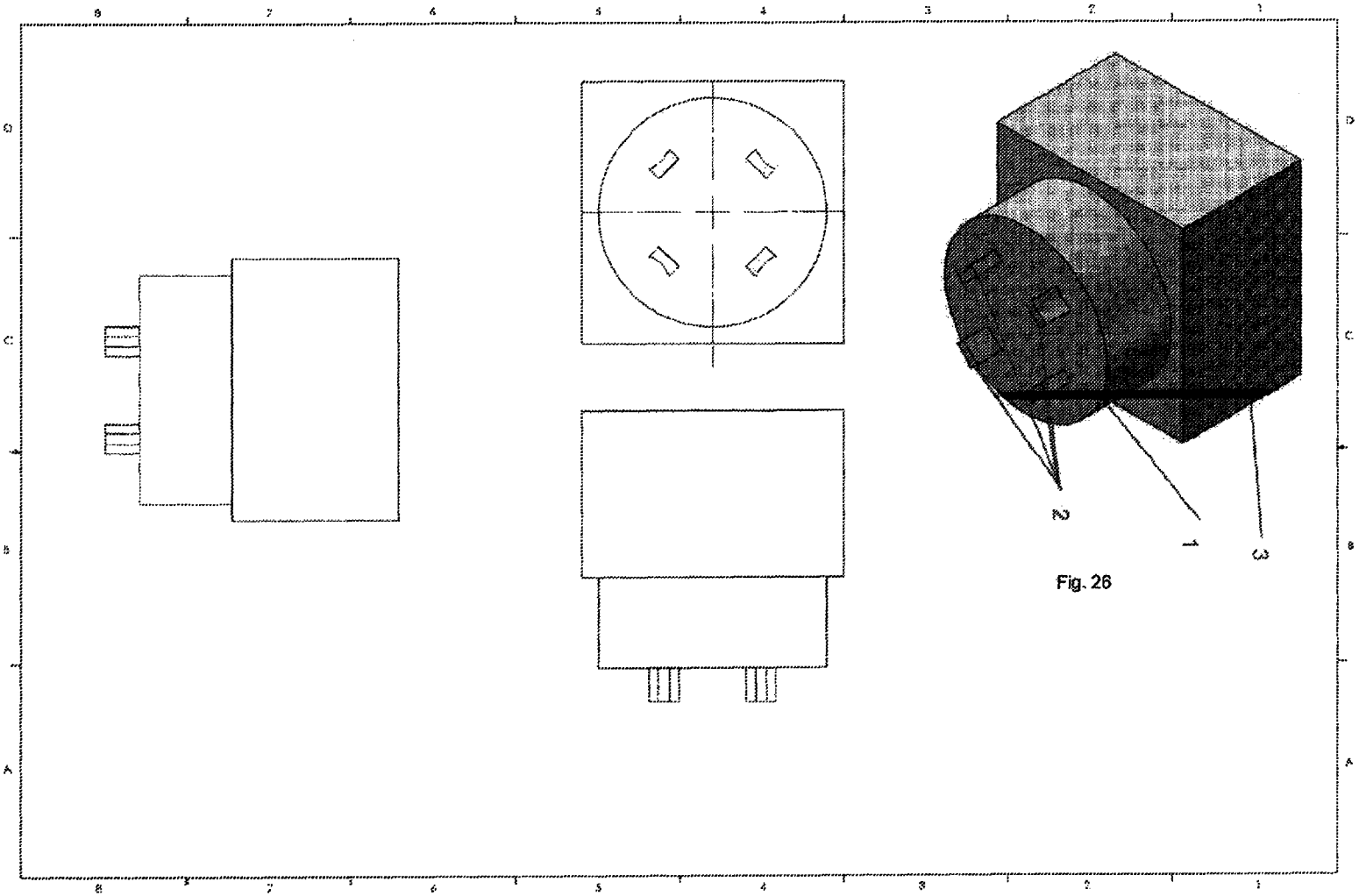

FIG. 26: Illustrates the Heat Anvil: The circular turret (1) protrudes through the bottom three plates of the FCHTMC to the A1 plate, (FIG. 9) where it seats. The caloric energy conduits (2) protrude through geometrical cavities in the A1 plate to the B2 plate, (FIG. 7*a-b*) where they terminate as the hot spots in each quadrant within the rotary-expansion device circular-cavity. In addition, it is depicted the square caloric energy storage mass (3) which when covered with foam insulation functions as a static caloric energy storage device.

Figures 27A, 27B:
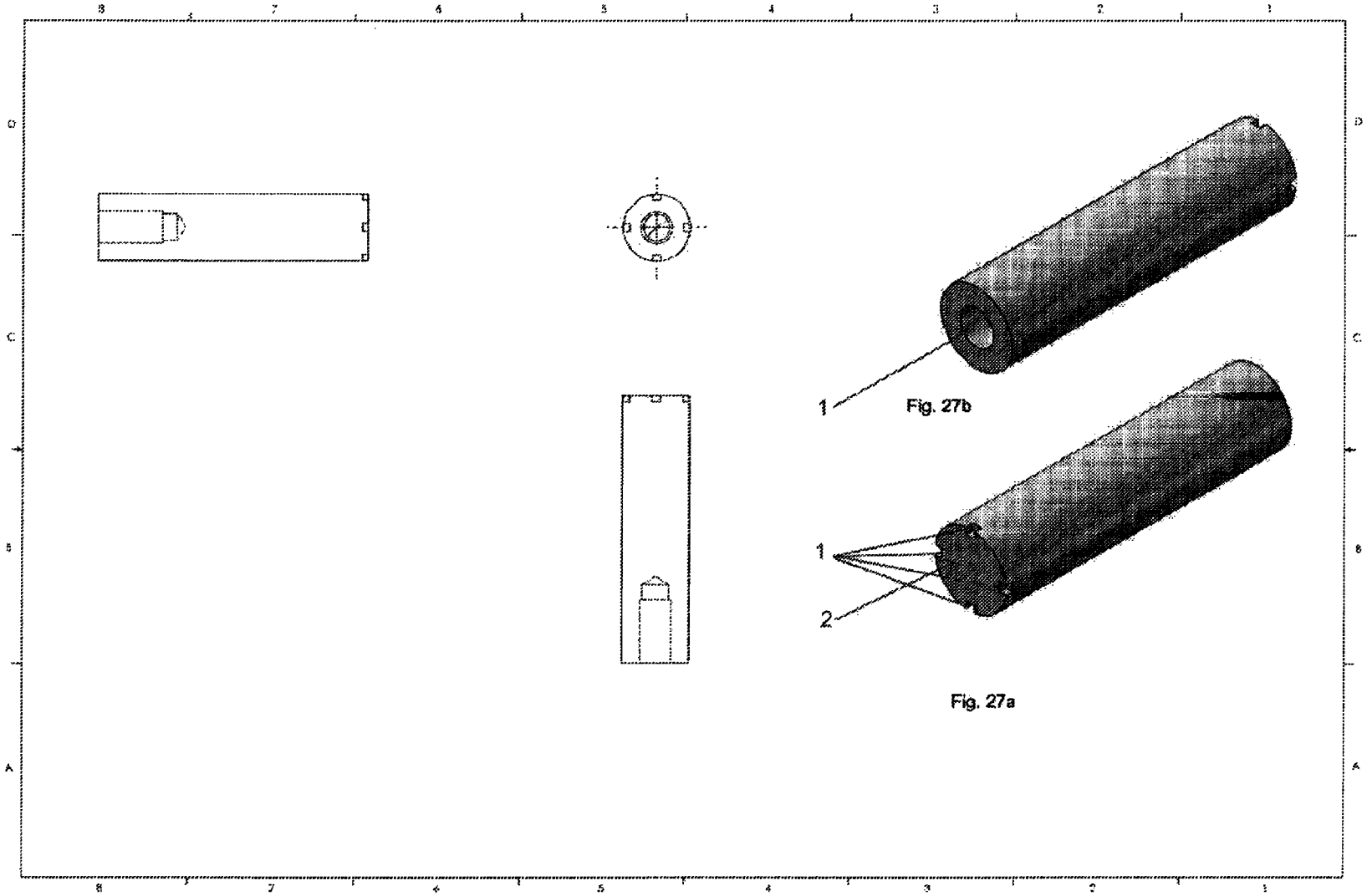

FIG. 27: Illustrates the Rotary expansion device: The rotary expansion device (FIG. 27*a*) is the working fluid metering, dispenser unit within the engine. When the rotary expansion device is spun, by 90 degrees increments whereas a mini-pot (1) transports a droplet of liquid working fluid from the pre-evaporation, (FIG. 8*a-b*) cell to the evaporation cell. The rotary expansion device and the heat anvil probe, (FIG. 26) intersect in the construction between the B1 & B2 plates, (FIG. 7*a-b*) & (FIG. 8*a-b*) that form the evaporation cell. The droplet boils into vapor, which then enters the geometric channel on B2 plate upper surface to enter the associated cylinder. The base (2) of the rotary-expansion device rotates inside the seat provided in the B1 plate, (FIG. 8*b*)(5). The top end of the rotary expansion device (FIG. 27*b*) contains a 10/32 thread insert (1) to allow secure attachment of the magnet assembly used to provide rotation of the rotary expansion device.

Figure 28:
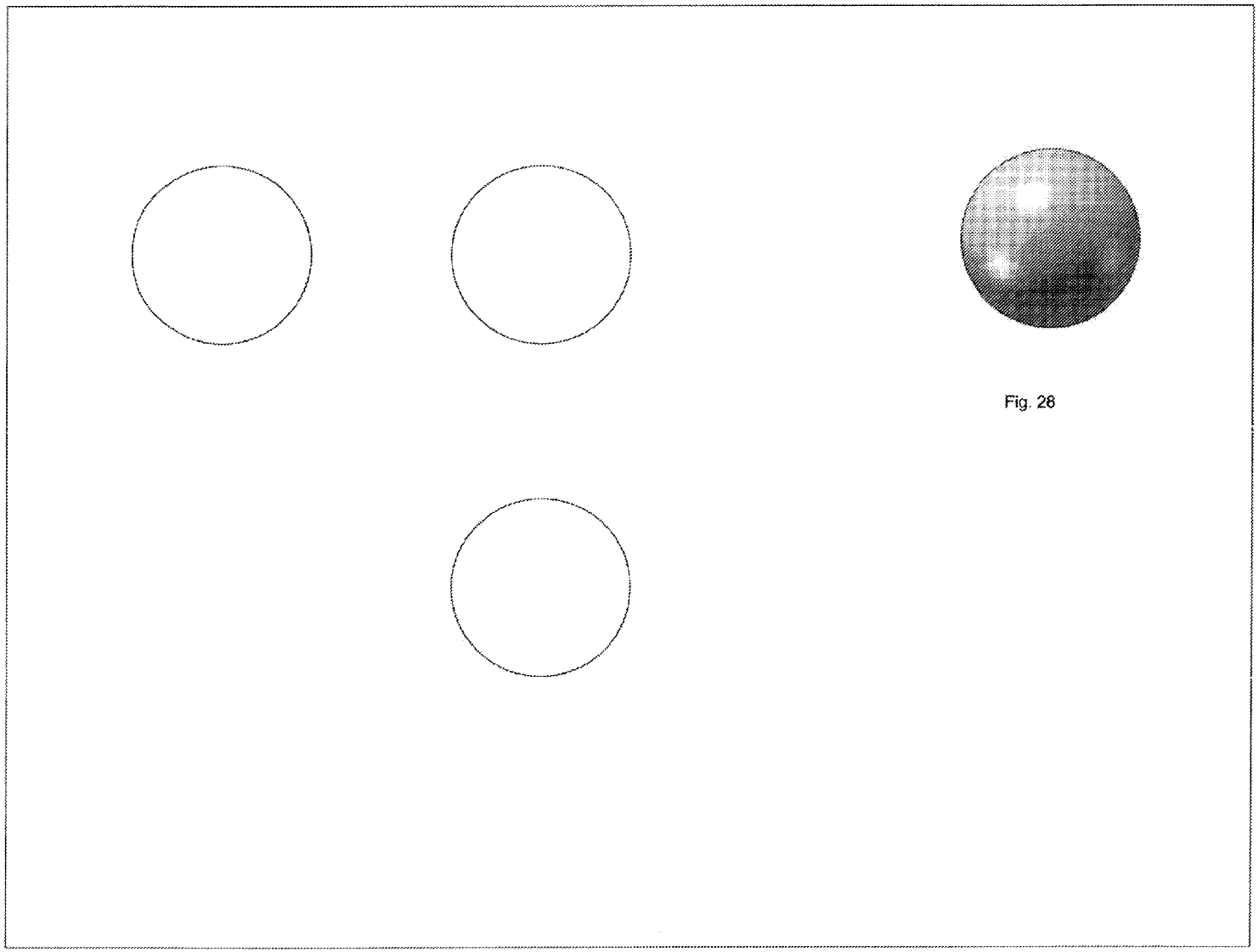

FIG. 28: Illustrates the Cone Ball. Cone balls (FIG. 28) are the centrifugal compressor agents in the cone compressors. As their density is higher than that of the vapor, the ball which is assisted by centrifugal force pushes the vapor in front of it to the exit circular cavity causing a high-pressure stream of vapor to exit. The faster the engine turns the higher the speed of ball transfer and the respective pressure, of the vapor stream. A direct relationship!

Figure 29:
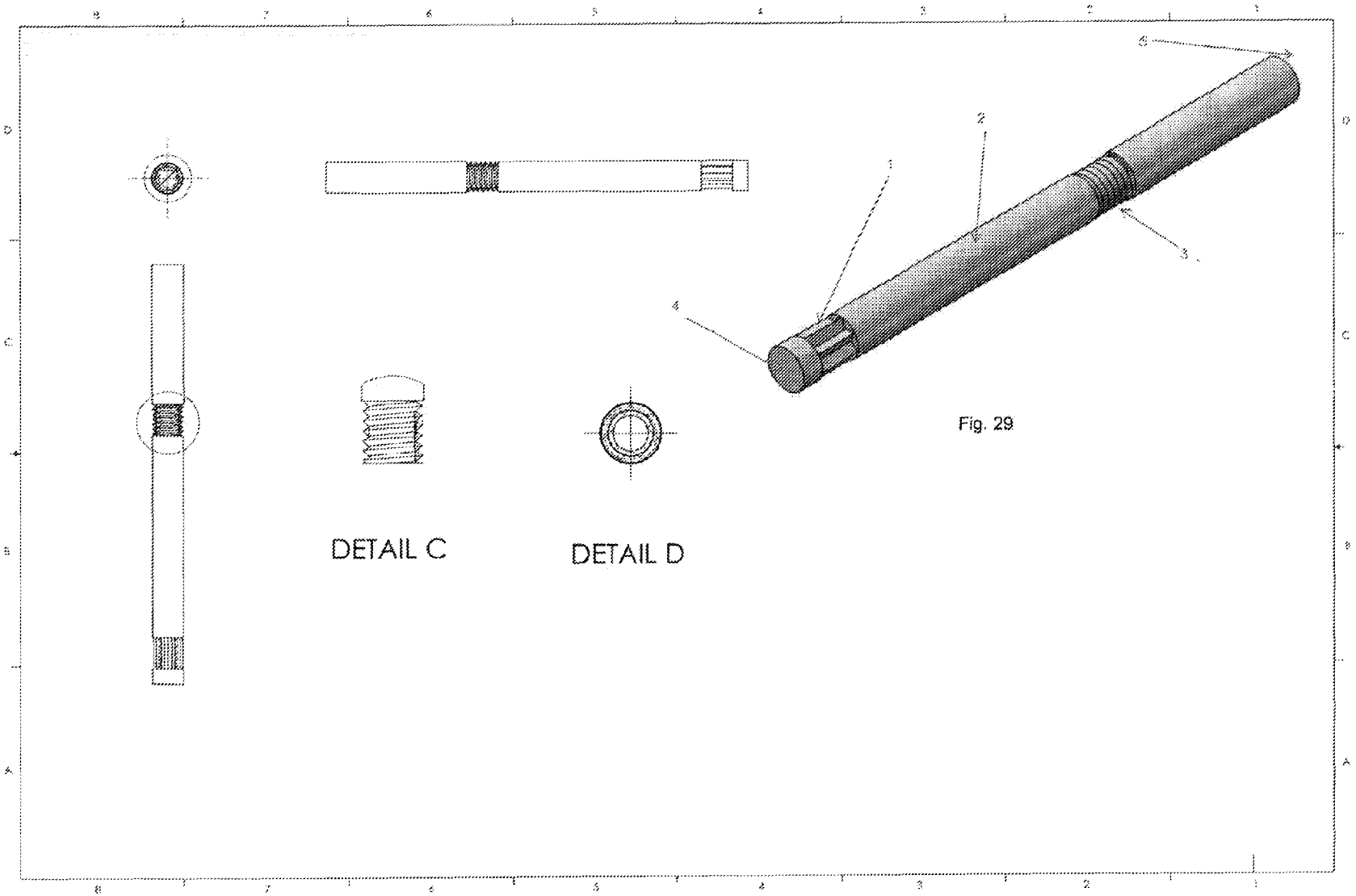

FIG. 29: Illustrates the Cone Drive Rod: The cone drive rod (FIG. 29) transfers energy from the spur gear, FIG. 18*a* (3) on the main shaft to the cone compressor, (FIG. 19*a-b*, 20*a-c*, 21*a-c* & 22*a-b*). The gear provides thrust to the rod gear (1) that then rotates the spiral gear (3) to turn the gears on the outer compressor cones, (FIG. 20*a-c*) & (FIG. 22*a-b*). The top (4) of the cone drive rod seats into the bottom of the E1 plate, (FIG. 6*a-b*). The bottom end (5) of the cone drive rod seats into the B2, (FIG. 7*b*(10)) upper layer.

DETAILED DESCRIPTION

Referring now to FIG. 1:

Item (2) the (E1) plate, is the top plate of the assembly. The outer surface of the (E1) plate provides four circular cavities and a mounting surface to the four mounting bolts. This plate is also the final bearing surface for the central shaft. The inside surface of the plate provides sockets into which the tops of the cone-drive-rods Item (25) rotate.

Item (13) is the COM spacer, which provides space for the PLC, and associated electronics, electromagnetic, and magnetic components. These items mount on a circuit board that secures to the top of the (D1) plate Item (1).

Item (1) the (D1) plate, the rotary expansion devices terminate on the top surface of the (D1) plate where a ring magnet attached to the top of the rotary expansion device serves as the stepper motor rotor. The central shaft Item (14), the four expansion device cylinders, and the cone-drive-rods Item (15) pass through the (D1) plate Item (1).

Item (12) the (C3) plate on its upper surface geometrical cavities provides for exhaust vapors expansion the bottom surface of the (D1) Item (1) plate seals these cavities. The central shaft Item (14), the four expansion device cylinders, and the cone-drive-rods Item (15) pass through the (C3) plate. On (C3) plate, lower surface has geometrical cavities for the ¼ of the cylinder(s). Item (25) the cone ball storage tracks occupy geometrical cavities on the bottom surface of the (C3) plate. The compressed exhaust vapor circuit originates on the lower surface of the (C3) plate then proceed through the cone drive rod circular cavities to the (B2) plate Item (3). There the compressed vapors proceed to a circular cavity leading to the heat exchanger.

Item (10) the (C2B) plate completes the ⅛ upper center of the cylinder geometrical cavities. It also contains ⅓ of the cone geometrical cavities.

Item (20) the (Oscillator) plate, two oscillator plates are used, one directly inverted under the other. Between the oscillator two oscillator plates, are clamped the spheres of the four pistons Item (21). The pockets routed into the oscillator plate insure each sphere limited radial movement but does not allow lateral movement. The center hole of each oscillator plate interfaces with the offset pin of the central shaft Item (14) the central shaft a circular construction with an offset pin on the lower end and a 6/32 threaded circular cavity. A spur gear to drive the cone-drive-rods. The central shaft-circumscribing surface receives polishing to enhance sealing and sliding. The central shaft proceeds through the E1, D1, and C3 plates with surfaces polished for sliding and sealing. The offset pin proceeds through the oscillator plate Item (19) to the central shaft base Item (21).

Item (25) the cone drive rods. The cone-drive rods interface with the gear on the central shaft under the (E1) plate then transport that radial energy to the outer compressor cone(s) Item (16,18) through the action of a worm gear.

Item(s) (17,18) the inside-cone, there are two inside cones one clockwise the other counter-clockwise. These inside cones mate with the clockwise and counter-clockwise outer cones Item(s) (17,19). Two tabs on the inside cone mate with corresponding notches in the outer cone to lock the inner and outer cones together, the cone containment cavity insures that this lock remains solid. The inner cones contain ½ the geometrical cavity creating an extended sinusoidal path that follows the ball acceleration vectors of the cone balls created by cone rotation. The inner cone contains geometry on its rear face to create a cavity path to aid acceleration of the balls from the cavity wall into the cone assembly.

Item(s) (17,19) the outer cones, there are two outside cones one clockwise the other counter-clockwise. These outside cones mate with the inside cones Item(s) (16,18). The outer cones mate with the cone-drive rods with a spur gear located on the tip of the outer cone. Just behind the cone-gear, a mitered hole designates the cone-ball exit circuit where the balls decelerate into a cavity defined as the cone-ball-storage-track. At that point, compressed vapors proceed to the cone-drive-rod circular cavities.

Item (11) the (C2) plate completes the ⅛ lower center of the cylinder cavity geometry. It contains ⅓ of the geometry to create the cone containment cavity. The rotary expansion devices proceed through four circular cavities to the next plate. The four mounting screws proceed through four circular cavities to the next plate. The cone drive rods proceed through two circular cavities to the next plate.

Item (9) the (C1) plate on its upper surface completes the remaining geometrical cavity for the cylinders and the cones. The cylinder-input ports proceed through circular cavities from the cylinders continue through to the lower side of the (C1) plate where the vapor originates. Four circular cavities provide continued through progress for the rotary expansion device and mounting holes. Two circular cavities provide continued through progress for the cone-drive-rods Item (25) to continue through to the next plate.

Item (3) the (B2) plate contains geometrical cavities to guide compressed vapor from the two cone-drive-rod-seating areas, which are routed to a circular cavity to continue through to the next plate. A circular cavity for the central shaft base to rotate in receives polishing to promote sliding. Geometrical routes proceed from each rotary expansion device to the respective plate (C1) cylinder input circular cavity. On plate (B2), the lower surface contains the upper cavity geometry of the liquid retention reservoir. The lower surface of B2 plate receives polishing to promote sealing. Four circular cavities provide continued through progress for the mounting holes.

Item (4) the (B1) plate contains a geometrical cavity of the lower retention reservoir. Four circular cavities provide expansion device seating; these surfaces receive polishing to promote sliding. The remaining upper surface of the (B1) plate receives polishing to promote sealing. Four circular cavities provide continued through progress for the rotary expansion device and mounting holes. Two circular cavities provide continued through progress for the cone-drive-rods Item (25) to continue through to the next plate. One circular through cavity provides for compressed exhaust vapor, one circular through cavity provides for liquid fluid return from the heat exchanger. Four circular cavities provide continued through progress for the mounting holes.

Item (6) the (A1) plate provides four geometrical slot cavities to allow the heat anvil caloric-transfer-headers (part of Heat Anvil Item (23)). Four circular cavities provide continued through progress for the rotary expansion device and mounting holes. One circular cavity provides for compressed exhaust vapor, one circular through cavity provides for liquid fluid return from the heat exchanger. Provided on the lower surface of the (A1), plate the top end of the turret of the Heat Anvil Item (23) seats into a centered circular cavity. Four circular cavities provide continued through progress for the mounting holes.

Item (5) the (A1) plate the fuel based caloric input plate provides for combustion of a vapor fuel. A circular through cavity provides for the heat anvil turret. Provided, a groove circumscribing cavity provided for the turret on the top surface of the (A1) plate that allows induction of caloric energy absorption from fuel vapors. Four through circular cavities provide exhaust gas progression to groove cavity passages located on the lower plate of the (A1) plate. Four circular cavities provide continued through progress for the mounting holes. On the side of the (A1) plate, a circular cavity provides for air input to the fuel reaction. In the middle of that circular cavity, a circular cavity appears from the lower plate. This cavity provides passage for fuel vapor. A small patch of SCHOTT combustion matrix is seated into the hole where it enters the circular induction a spark wire from the PLC ignites the fuel/air mixture just inside the combustion matrix.

Item (7) the (A) mounting plate, one circular through cavity provides heat anvil turret passage. Four through circular cavities provide for the mounting bolts. One circular cavity provides for compressed exhaust vapor to the heat exchanger. One circular cavity provides for liquid fluid return from the heat exchanger. One through circular cavity provides for fuel vapor to the (A1) plate. One through threaded circular cavity provides for ¼ NPT fuel connection. Three through threaded circular cavity for ¼ NP heat exchanger connection. The lower surface of the (A) mounting plate receives polishing to promote sealing.

Item (8) the (B) mounting plate, four through circular threaded cavities provide for seating the mounting bolts. One through circular cavity provides for the heat anvil turret. One geometrical cavity on the upper surface of the (B) mounting plate, to guide the progress of fuel vapor from the NPT input to the circular cavity provided in the (A) mounting plate. One geometrical cavity on the upper surface of the (B) mounting plate, to guide compressed exhaust vapor to the heat exchanger NPT interface. One geometrical cavity on the upper surface of the (B) mounting plate, to guide liquid fluid return from the heat exchanger to the circular cavity provided in the (A) mounting plate.

Item (23) the heat anvil. In the original application submission, this item consists of solid copper. Recently the part's re-engineering have created a ceramic assembly to replace the copper saving both weight and part cost. The engineering drawings of this replacement component are not quite ready at this time.

REFERENCE NUMERALS WITH INDEX TO DETAIL DRAWINGS

Figure 2:
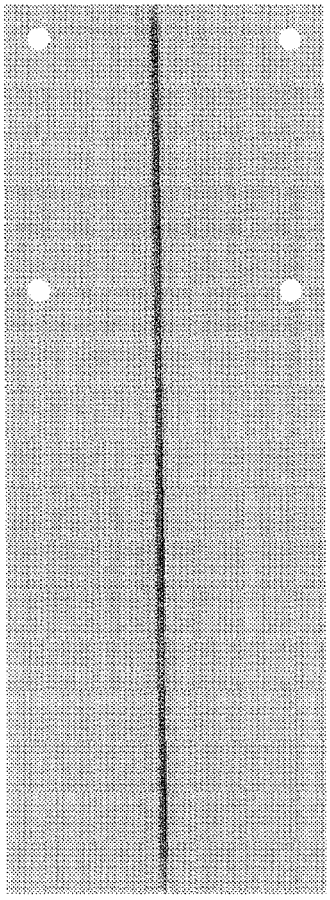
FIG. 2 is a perspective bottom view of the Fchtmc device, showing the Heat-Anvil, the four threaded holes, which the mounting-screws terminate.
Figure 3:
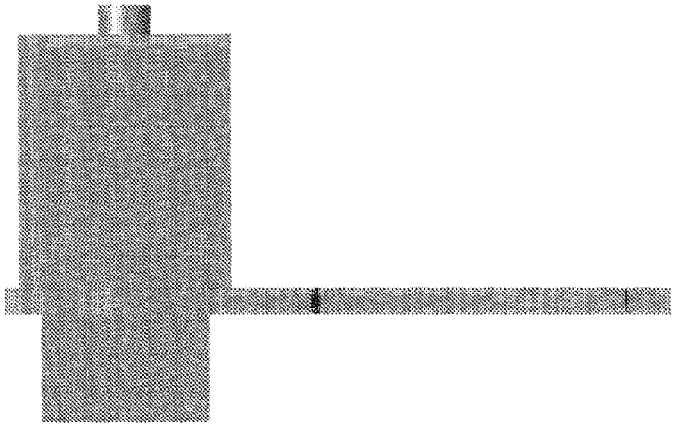
FIG. 3 is a perspective right-side view of the Fchtmc device, showing the output shaft, stack of eleven plates, mounting plates A and B, then the right-side of the Heat-Anvil.
Figure 4:
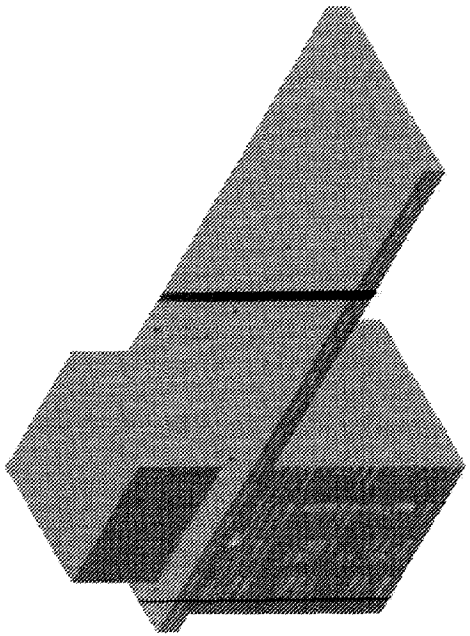
FIG. 4 is a perspective isometric view from the right-rear of the Fchtmc device.

1 Plate D1 FIG. 5*a-b*
2 Plate E1 FIG. 6*a-b*
3 Plate B2 FIG. 7*a-b*
4 Plate B1 FIG. 8*a-b*
5 Plate A1 FIG. 9
6 Plate A2 FIG. 10
7 Mounting Plate A FIGS. 11*a-b*
8 Mounting Plate B FIG. 12
9 Plate C1 FIG. 13*a-b*
10 Plate C2A FIG. 14*a-b*
11 Plate C2B FIG. 15*a-b*
12 Plate C3 FIG. 16*a-b*
13 Com Spacer FIG. 17
14 Central Shaft FIG. 18*a-b*
15 CCW Inner Cone FIG. 19*a-b*
16 CCW Cone Outer FIG. 20*a-c*
17 Cone Inner FIG. 21*a-c*
18 Cone Outer FIG. 22*a-b*
19 Oscillator Plate FIG. 23
20 Piston FIG. 24
21 Base FIG. 25
22 Heat-Anvil FIG. 26
23 Rotary Expansion Control FIG. 27*a-b*
24 Cone Ball FIG. 28
25 Cone Drive Rod FIG. 29

Assembly of the Invention

The Heat Anvil must be placed through the mounting plate; then the A1 gaseous fuel burner must be placed over the heat collector, then the A2 lower refrigerant cell plate must be installed, then the B1 upper refrigerant cell plate must be installed, then the B2 vapor control plate must be installed. Next, the C1 manifold plate is installed, then the C2 oscillator cavity plate must be installed, then the oscillator is placed with the index protrusion inserted into the quadrant 00 position. The C3 exhaust manifold plate must then be installed. Next the vapor pump cones complete with balls must be installed be sure to place the proper cone in each position. Then the eccentric prong of the central shaft must be inserted into the oscillator it seats into B1. Then each rotary expansion device, aligned with the index in home position must be installed. Next, the D1 quadrant exhaust/vapor pump input manifold plate must be installed. Then the magnet heads must be installed onto rotary expansion device with the index at home position. Then the D1 spacer must be installed, and then the vapor pump drive gear must be installed. Then the E1, containment plate must be installed. Then the four mounting bolts are firmly pushed down through the plates then tightened to approximately 25 ounce inches of torque. Finally, install the heat exchanger onto the mounting plate.

All of the above plates and components in the prototype of the device are constructed of machined (drilled, milled, ground, and polished) MACOR™ material, a product of Corning Glass. These components of the device may also be press-molded from Z500™, a sister product of Morgan Advanced Ceramics. The usage of these materials to construct this device is due to their unique properties: Zero grain, very low thermal conductivity, high dimensional stability, high flexural strength, extreme hardness (toughness), and shock resistance. A known fact that to obtain an AA grade surface finish on any surface of these materials by the appropriate grinding and polishing. Mated AA surfaces have two properties, which are essential within this device: 1) Practically zero friction, 2) Gas-tight vapor seal. In construction of the prototype and in production, grinding and polishing of specific areas to an AA-grade surface finish is necessary. The exploded component views note those surfaces where the AA-grade finish is required.

To provide a backup gas-tight vapor seal, a self-priming silicone adhesive is placed into circumventing grooves cut into each plate of the device. After assembly and curing of the adhesive, establish a vacuum of 25 cm through the fitting attached to the heat exchanger portion of the device.

Then the refrigerant gas is loaded into the device through this fitting. This fitting is effectively closed off. This refrigerant gas must be DURACOOL™, a hydrocarbon refrigerant which is not ozone depleting. DURACOOL™ has similar (if not better) vapor vs. pressure characteristics than HFC 134*a*. This makes DURACOOL™ an ideal working refrigerant for this device.

Then attach the PLC electrical control cables. Place a lithium battery into the receptacle on the PLC to provide the initial power source to operate the refrigerant inlet control rotary expansion device. Connect a mechanical load to the central shaft. The device is now ready to operate.

Method of Operation

The PLC contains a rechargeable-lithium battery and a large pseudo storage capacitor to provide initial power to operate the refrigerant inlet control valve stepper motors. This auxiliary power source must be capable of operating the PLC and stepper motors for a minimum of 25 seconds, providing enough time to start the heat engine. After the heat engine is operating, (central output power shaft is rotating), a permanent magnet dynamo type electrical generator provides operating power to the PLC. The PLC uses a 1-Wire™ network to control the device, determine the status of the device, and to detect and control the various planned peripheral devices for the device.

In the prototype of the device, butane fuel provided from a cartridge placed into the vaporized input receptacle on the device mounting plate. The PLC tests the fuel pressure via the 1-wire network. If fuel is available, the PLC opens the fuel inlet valve allowing a small amount of fuel to progress into the burner. As the fuel passes the burner inlet the fuel velocity causes ambient air to mix with the fuel. The PLC then generates a spark to ignite the fuel in the burner ring using a piezoelectric-transformer. This sequence repeats up to six times maximum, at which time a definite temperature rise detected by the thermal sensor embedded into the heat collector. If no heat is available the PLC lights the low fuel fault indicator, and then the PLC enters sleep mode to conserve power. If the low-fuel condition exists greater then five minutes, the PLC will shut down and enter the OFF State. At this point, it will not attempt to restart without additional operator intervention.

Once the PLC has detected the availability of a minimal threshold of heat (40 degrees F. temperature rise at the heat collector), the heat engine rotational start-up sequence begins. The PLC checks the angular displacement of the central power output shaft to determine which probe of the oscillator is at the peak of its travel. Next, the PLC commands the appropriate refrigerant inlet control rotary expansion device to rotate one full revolution (360 degrees). As the refrigerant inlet control, rotates, four droplets of liquid refrigerant rotates into the proximity of the heat collector. The refrigerant droplets absorb heat energy and boil into a vapor. The temperature of the heat collector determines the pressure of this refrigerant vapor.

The refrigerant vapor then fills the conduit, which communicates with the oscillator cavity. Expansion of the refrigerant vapor then forces the oscillator probe to retract. This causes the entire oscillator to move within the oscillator chamber. This motion of the oscillator applies force to the eccentric pin on the central shaft, causing it to rotate. This rotational energy is then available to drive an external load.

As the oscillator probe retracts, the tip of the oscillator probe moves far enough to expose the expiring vapors to an exhaust port for this quadrant. The remaining refrigerant vapor pressure is relieved as the refrigerant progresses into the exhaust port buffer area and onward to the vacuum created by the vapor pump. The cone vapor pump compressor uses a ball that accelerates by centrifugal force pushing the refrigerant before it. The refrigerant, which condenses into liquid as it, travels through the waste heat exchanger, whereupon the liquid refrigerant then returns to the B1 plate via conduit re-entering the rep-evaporation refrigerant storage cell. The closed refrigerant cycle remains within the gas-tight sealed portion of the device, progressing through a continuous repetitive cycle of evaporation, expansion, compression, and condensation.

This operation repeats for each of the four quadrants of the oscillator cavity in the following binary order: 00-01-10-11. The PLC controls each rotary expansion device timing. To vaporize a droplet (or multiple droplets) of refrigerant just as the oscillator probe passes the appropriate position to allow the most efficient expansion of the refrigerant vapor.

The refrigerant inlet control rods are able to dispense from one to sixteen droplets of liquid refrigerant to produce the vapor pressure necessary to drive the load. 16 droplets dispensed by four complete 360-degree rotations of the valve. The PLC completely controls this sequence. Because each power cycle only begins when the appropriate refrigerant inlet rod rotates, any fault, malfunction, or unforeseen event that prevents the PLC from operating results in immediate "power-down" condition of the central shaft, protecting the device and its load from any damage that might be caused by excessive rotational speed.

Conclusions

On this basis the device will continue operation, until it is instructed to stop or fuel is exhausted, producing work efficiently, nearly silently, smoothly, and reliably. Any maintenance requirements of the device are unknown at this time. The extremely hard and low-friction surfaces of the internal moving parts require no lubrication. The only mechanical part subject to wear is the main support bearing for the central shaft. This surface, once prepared to an AA finish, as is this area of the power shaft, establishes a so-called glass-on-glass interface, which is virtually friction-free assuring the possibility of extremely long life. There are no reciprocating internal parts to excessive vibration or wear. Motion of the oscillator produces only a very small vibratory moment due to its relatively low mass. Also, because there are four to six power pulses of expanding refrigerant per 360 degree rotation of the central power output shaft, therefore there is no need for a large or heavy flywheel on the central shaft. The design contains a self-evacuation feature. As the torus of each piston reaches its apogee the exhaust port for that quadrant accesses the internal area of the oscillator, vacuuming the area by the cone-pump action into the flow of the fluid. Therefore, nearly all vapors that may leak are contained within the device by various negative atmosphere operations, which serve to protect the internal integrity of the device.

The advantages of this device are manifest: With the herein-described device, caloric energy expounding smooth motion at high efficiency and with great reliability. The components of the device are extremely simple in construction and can readily be manufactured at an economical cost, due its construction from a number of individual flat plates, round or cylindrical parts. The PLC contains programming to switch easily from one heat source to another. Therefore, this device can use any one of a number of convenient and efficient methods of "external" fuel combustion as its heat source. Slow complete combustion with the aid of a multi-flame combustor matrix can produce a nearly smokeless burn with conventional fossil fuels. Carbon-free fuels such as hydrogen in the burner are totally green. A method of operation that is totally non-global warming is available by using the infrared component of regular sunlight as the heat source. Changes in specification and form of this device as herein described may be made within the scope of what is claimed, without departing from the spirit of the device.

The invention claimed is:

1. A four quadrant cylindrical cavity heat engine, comprising:

a. a substantially sealed block formed of multiple ceramic plates containing geometric cavities designed to confine all internal components within;

b. a caloric energy absorption and storage device designed to fit into the base of the engine block then defining the hot path in each quadrant, designated as the heat anvil;

c. a central cavity created between two plates holding liquid working fluid then defining the cold path in each quadrant;

d. a rotary expansion device in each quadrant circularly sliding inside a cylindrical cavity between the cold-path and the hot path, in communication with the hot path and cold path and to the cylinder cavity of the quadrant;

e. a horizontal cylindrical cavity defined between multiple ceramic plates in each quadrant defining the sliding path of the piston of that quadrant and containing a cone shaped piston, then defining a hot working fluid entry and exit;

f. a cone shaped piston having rounded edges to allow minimal angling of the piston without compromising the sealing union of the cylinder and piston, while the piston is sliding within the cylinder, the piston is terminated by a ball;

g. a central oscillator consisting of two oscillator plates one inverted under the other in communication with the ball terminus of each quadrant piston and the offset pin of the central shaft;

h. a central shaft projecting outside the engine block at the top circularly sliding inside a circular cavity within the center of the engine block, the offset pin of the central shaft in communication with the center cylindrical cavity of the oscillator and the cylindrical offset cavity of the central shaft base;

i. a gear attached to the central shaft communicates circular energy to the two cylindrical cone drive rods, in addition on the underside of the gear four cylindrical magnets are attached that interact with corresponding coils located on the microcomputer printed circuit board;

j. a cone drive rod circularly sliding in the circular cavity positioned exactly in between each two cylinder quadrants in communication with the gear of the central shaft to communicate circular energy to the cone compressor;

k. a cone compressor in communication with a cone drive rod through a helical gear to worm gear interface, the cone compressor formed by locked outer and inter ceramic cone pieces circularly sliding inside the geometrical cavity defined within layers of the engine block;

l. a cone ball entering the cone from a circular cavity within the engine block then circumscribing the decreasing radius arc defined by the track formed between the inner and outer cones, accelerated by the rotation of the cone then exiting the cone at high force pushing vaporous working fluid into the regeneration cavity towards the heat exchanger, the ball then returns to the storage track pushing the next sequential ball out of the opposite end of the ball storage track into the circular hot vapor cavity progressing to the cone compressor.

2. A heat anvil as set forth in claim 1, comprising:

a. a device formed of copper shaped into a turret at the top to project through the circular cavity provided within the engine block plate al and mounting plates a1 and b1, copper extrusions project from the top of the turret through cavities within the lower a2 plate and b2 plate to designate a hot path in each quadrant;

b. the device continues below the circular portion and the b1 mounting plate of the engine block then progresses into a square block 2×2×2 inches covered with insulation foam as caloric energy storage media;

c. a focused fuel combustion area formed between the engine block plate a1 and plate a2 provides for fuel energy absorption utilizing air and fuel mixing then combustion in a matrix pad and a spark point, combustion exhaust exits over the al mounting plate;

d. a focused geothermal and solar input may be achieved by transferring that energy to an oil then injecting that oil through the air input circular cavity located on the side of the al plate, exhaust oil exits over the al mounting plate.

* * * * *